US006383698B1

(12) United States Patent
Okada et al.

(10) Patent No.: US 6,383,698 B1
(45) Date of Patent: May 7, 2002

(54) ELECTROPHOTOSENSITIVE MATERIAL USING QUINONE DERIVATIVE

(75) Inventors: Hideki Okada, Osaka; Masaaki Yokoyama, Nishinomiya, both of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/709,568

(22) Filed: Nov. 13, 2000

(30) Foreign Application Priority Data

Nov. 19, 1999 (JP) ..... 11-339516
May 2, 2000 (JP) ..... 2000-133637

(51) Int. Cl.[7] ..... G03G 5/047

(52) U.S. Cl. ..... 430/58.25; 430/56; 430/72; 430/75; 430/83; 430/58.15

(58) Field of Search ..... 430/56, 58.15, 430/58.25, 71, 72, 75, 83

(56) References Cited

U.S. PATENT DOCUMENTS 5,707,768 A * 1/1998 Anzai et al. ..... 430/71

FOREIGN PATENT DOCUMENTS

| | | | |
|---|---|---|---|
| JP | 6-110227 | | 4/1994 |
| JP | 7-181711 | * | 7/1995 |
| JP | 4-338760 | * | 11/1995 |

OTHER PUBLICATIONS

Neufeldt, V. et al., ed. *Webster's New World Dictionary,* Third College Edition, Webster's New Word Dictionaries, NY (1988), p 1252.*

Patent & Trademark Office English–Language Translation of JP 04–338760 (Pub. Nov. 1992).*

Derwent Abstract Acc. No. 1993–012379 describing JP 4–338760, 1993.*

Japanese Patent Office English–Language Translation of JP 7–181711 (Pub Jul. 21, 1995).*

* cited by examiner

*Primary Examiner*—Janis L. Dote

(74) *Attorney, Agent, or Firm*—Smith, Gambrell & Russell, LLP

(57) ABSTRACT

The present invention relates to an electrophotosensitive material comprising a conductive substrate and a photosensitive layer formed on the substrate, the photosensitive layer containing a quinone derivative represented by the general formula (1), (2) or (3):

(1)

(2)

(3)

wherein A represents an oxygen atom or a sulfur atom; $R^1$ to $R^{14}$ are the same or different and each represents an alkyl group or an aryl group; and m and n represent an integer of 0 to 4. The electrophotosensitive material has high sensitivity.

12 Claims, 5 Drawing Sheets

ELECTROPHOTOSENSITIVE MATERIAL USING QUINONE DERIVATIVE

BACKGROUND OF THE INVENTION

The present invention relates to an electrophotosensitive material containing a quinone derivative having an excellent electric charge transferability, which is used in image forming apparatuses such as electrostatic copying machine, facsimile and laser beam printer.

In the image forming apparatuses, various photosensitive materials having the sensitivity within a wavelength range of a light source used in the apparatus are used. One of the photosensitive materials is an inorganic photosensitive material using an inorganic material such as serene in a photosensitive layer and another one is an organic photosensitive material (also referred to as an organic photoconductor, OPC) using an organic material in a photosensitive layer. Recently, the organic photosensitive material among these photosensitive materials has widely been studied because it is easily produced as compared with a conventional inorganic photosensitive material and that it has advantages such as wide range of choice of photosensitive materials such as electric charge generating material, electric charge transferring material and binder resin, and high functional design freedom.

The organic photosensitive material includes a so-called multi-layer type photosensitive material having a laminated structure of an electric charge generating layer containing an electric charge generating material and an electric charge transferring layer containing an electric charge transferring material, and a so-called single-layer type photosensitive material wherein an electric charge generating material and an electric charge transferring material are dispersed in the same photosensitive layer. Among these photosensitive materials, the multi-layer type photosensitive material is exclusively put into practical use and, furthermore, a multi-layer type photosensitive material comprising an electric charge transferring layer having a film thickness larger than that of the electric charge generating layer at an outermost layer is used more generally in view of the mechanical strength.

It is required that the electric charge transferring material used in these organic photosensitive materials has high carrier mobility. However, since almost all of electric charge photosensitive materials having high carrier mobility have hole transferability, the multi-layer type photosensitive material comprising the electric charge transferring layer at the outermost layer becomes a negatively charging type one inevitably.

However, this negatively charging type organic photosensitive material must be charged by negative corona charge accompanied with the generation of a large amount of ozone, thereby to cause problems such as influence on the environment and deterioration of the photosensitive material itself.

To solve the problems described above, it has been studied to use an electron transferring material as the electric charge transferring material, thus suggesting, as the electron transferring material, a diphenoquinone derivative represented by the general formula (EA1):

(EA1)

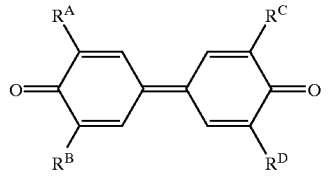

wherein $R^A$, $R^B$, $R^C$ and $R^D$ are the same or different and each represents a hydrogen atom, an alkyl group having 1 to 4 carbon atoms, an aryl group having 6 to 12 carbon atoms, an aralkyl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms, or a benzoquinone derivative represented by the general formula (EA2):

(EA2)

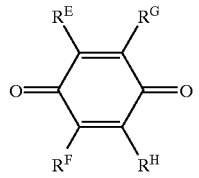

wherein $R^E$, $R^F$, $R^G$ and $R^H$ are the same or different and each represents a hydrogen atom, an alkyl group having 1 to 4 carbon atoms, an aryl group having 6 to 12 carbon atoms, an aralkyl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms.

Japanese Published Unexamined Patent Application (Kokai Tokkyo Koho Hei) No. 6-110227 suggests to use, as the electron transferring material, a naphthoquinone derivative represented by the general formula (EA3):

(EA3)

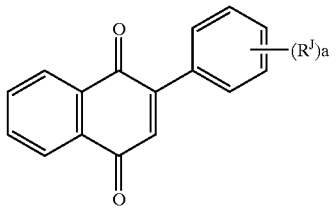

wherein $R^J$ represents a hydrogen atom, a substituted or non-substituted alkyl group, a substituted or non-substituted phenyl group, a halogen atom, an alkoxycarbonyl group, a N-alkylcarbamoyl group, a cyano group or a nitro group, and 'a' represents an integer of 1 to 3.

However, injection of electrons into the electron transferring material from the electric charge generating material was insufficient because of poor matching of conventional electron transferring materials such as diphenoquinone derivative (EA1), benzoquinone derivative (EA2) and naphthoquinone derivative (EA3) with the electric charge generating material. Since such an electron transferring material has low compatibility with a binder resin and is not uniformly dispersed in a photosensitive layer, the hopping distance of electrons becomes longer and electrons are less likely to move at low electric field.

Accordingly, as is apparent from electrical characteristics test described in Examples described hereinafter, the above-described conventional photosensitive material containing an electron transferring material had problems such as high residual potential and poor sensitivity.

The single-layer photosensitive material has advantages that one photosensitive material can be used in both of positively and negatively charging type apparatuses by using electron and hole transferring materials in combination. However, there arise problems that, when using diphenoquinone derivative (EA1), benzoquinone derivative (EA2) and naphthoquinone derivative (EA3) described above as the electron transferring material, a charge transfer complex is formed by an interaction between the electron and hole transferring materials, thereby inhibiting transfer of electrons and holes.

SUMMARY OF THE INVENTION

Thus, an object of the present invention is to solve the technical problems described above and to provide an electrophotosensitive material whose sensitivity has been improved as compared with a conventional one.

While studying intensively to solve the problems described above, the present inventors have paid attention to the fact that (a) a planar structure molecule having an acceptable functional group is generally suited for use as an electron transferring material, however, (b) such a molecule is of no practical use because of poor compatibility with a binder resin, and they have studied furthermore to enhance the electron acceptability and electron transferability by further introducing an acceptable functional group into a diphenoquinone derivative as a conventional typical electron transferring material, and to improve the solubility of the compound and compatibility with the binder resin.

As a result, they have found a new fact that:

(A) a furan ring or thiophene ring is introduced in the direction of a quinone functional group of a diphenoquinone derivative to extend a π electron conjugated system in said direction and a predetermined substituent is introduced into the quinone functional group, or (B) a naphthalene ring or anthracene ring is introduced in the direction of a quinone functional group of a diphenoquinone derivative to extend a π electron conjugated system in said direction and the direction which intersects perpendicularly to said direction and a predetermined substituent is introduced into the quinone functional group, thereby making it possible to obtain a compound having high electron transferability and improved solubility and compatibility with the binder resin, and that an electrophotosensitive material which has low residual potential as compared with a conventional one and high sensitivity can be obtained by incorporating such a compound as the electron transferring material. Thus, the present invention has been completed.

First electrophotosensitive material according to the present invention comprises a conductive substrate and a photosensitive layer formed on the conductive substrate, the photosensitive layer containing a quinone derivative represented by the general formula (1):

(1)

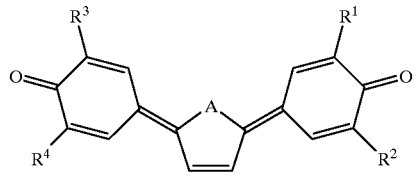

wherein A represents an oxygen atom or a sulfur atom, and $R^1$, $R^2$, $R^3$ and $R^4$ are the same or different and each represents an alkyl group having 1 to 4 carbon atoms, or an aryl group having 6 to 12 carbon atoms, which optionally has an alkyl group having 1 to 4 carbon atoms.

Second electrophotosensitive material according to the present invention comprises a conductive substrate and a photosensitive layer formed on the conductive substrate, the photosensitive layer containing a quinone derivative represented by the general formula (2):

(2)

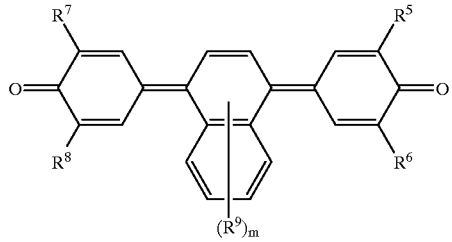

wherein $R^5$, $R^6$, $R^7$, $R^8$ and $R^9$ are the same or different and each represents an alkyl group having 1 to 4 carbon atoms, or an aryl group having 6 to 12 carbon atoms, which optionally has an alkyl group having 1 to 4 carbon atoms, and m represents an integer of 0 to 4.

Furthermore, third electrophotosensitive material according to the present invention comprises a conductive substrate and a photosensitive layer formed on the conductive substrate, the photosensitive layer containing a quinone derivative represented by the general formula (3):

(3)

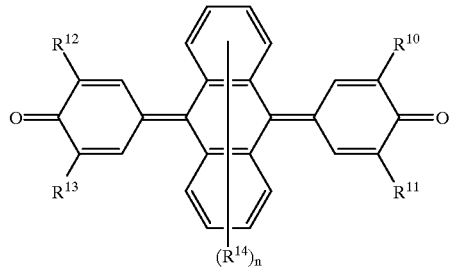

wherein $R^{10}$, $R^{11}$, $R^{12}$, $R^{13}$ and $R^{14}$ are the same or different and each represents an alkyl group having 1 to 4 carbon atoms, or an aryl group having 6 to 12 carbon atoms, which optionally has an alkyl group having 1 to 4 carbon atoms, and n represents an integer of 0 to 4.

The quinone derivative (terphenoquinone derivative) represented by the general formula (1) used as the electron transferring material in the electrophotosensitive material of the present invention has a very wide π electron conjugated plane because the π electron conjugated system is extended in the direction of the quinone functional group as compared with the diphenoquinone derivative as a conventional electron transferring material and the furan and thiophene rings having high electron acceptability are introduced into the center of a molecular skeleton, as described above. Therefore, the quinone derivative (1) has remarkably excellent electron acceptability in the whole molecule.

Furthermore, since the furan and thiophene rings as the five-membered ring exist in the center of the molecular skeleton, the molecule is bent at the portion of the five-membered ring while maintaining the π electron conjugated plane, thereby lowering symmetry of the whole molecule as compared with the diphenoquinone derivative. Therefore, the quinone derivative (1) has high solubility and good compatibility with the binder resin because an alkyl group and a phenyl group are substituted at both ends of the molecule, thereby making it possible to uniformly disperse in the photosensitive layer.

The quinone derivatives represented by the general formulas (2) and (3) used as the electron transferring material in the electrophotosensitive material of the present invention also have a very wide π electron conjugated plane similar to the quinone derivative of the general formula (1) because the π electron conjugated system is extended in the direction of the quinone functional group as compared with the diphenoquinone derivative as a conventional electron transferring material and also the π electron conjugated system is extended on almost the same plane as that of the benzene ring constituting the quinone functional group in the direction which intersects perpendicularly to said direction in the center of a molecular skeleton, as described above. Therefore, the quinone derivatives (2) and (3 ) have remarkably excellent electron acceptability in the whole molecule.

Furthermore, the quinone derivatives (1) to (3) are superior in matching with the electric charge generating material and injection of electrons from the electric charge generating material is smoothly conducted. Accordingly, the quinone derivatives (1) to (3) exhibit excellent electric charge transferability even at low electric field and are suited for use as the electron transferring material in the electrophotosensitive material. Moreover, since the quinone derivatives (1) to (3) do not form a charge transfer complex with the hole transferring material, they are used particularly preferably in the single-layer type photosensitive layer using the electron transferring material in combination with the hole transferring material.

The photosensitive layer containing the quinone derivatives (1) to (3) is superior in electron transferability at low electric field and is less likely to cause recombination of electrons and holes in the photosensitive layer, whereby apparent electric charge generation efficiency approaches an actual value. As a result, the sensitivity of the photosensitive material having such a photosensitive layer is improved. The residual potential of the photosensitive material is also lowered, thereby improving the stability and durability on repeated exposure.

Since the quinone derivatives (1) to (3) do not form a charge transfer complex with the hole transferring material as described above, a photosensitive material having higher sensitivity can be obtained when using them in a single-layer type photosensitive material containing the electron transferring material and hole transferring material in the same photosensitive layer.

In the electrophotosensitive material of the present invention, when the photosensitive layer contains a compound having a redox potential of −0.8 to −1.4as the electron acceptor, together with the quinone derivatives (1) to (3) (electron transferring material), the sensitivity of the photosensitive material is further improved.

The reason is assumed as follows. That is, the electron acceptor extracts electrons from the electric charge generating material and transfers the electrons to the quinone derivatives (1) to (3) as the electron transferring material, whereby the electrons are injected into the quinone derivatives (1) to (3) from the electric charge generating material more smoothly.

Considering the combination with the quinone derivatives (1) to (3), it is preferable to use those having a redox potential within the above range among the diphenoquinone derivative represented by the general formula (EAl) and benzophenone derivative represented by the general formula (EA2).

DISCLOSURE OF THE INVENTION

Figure 1:
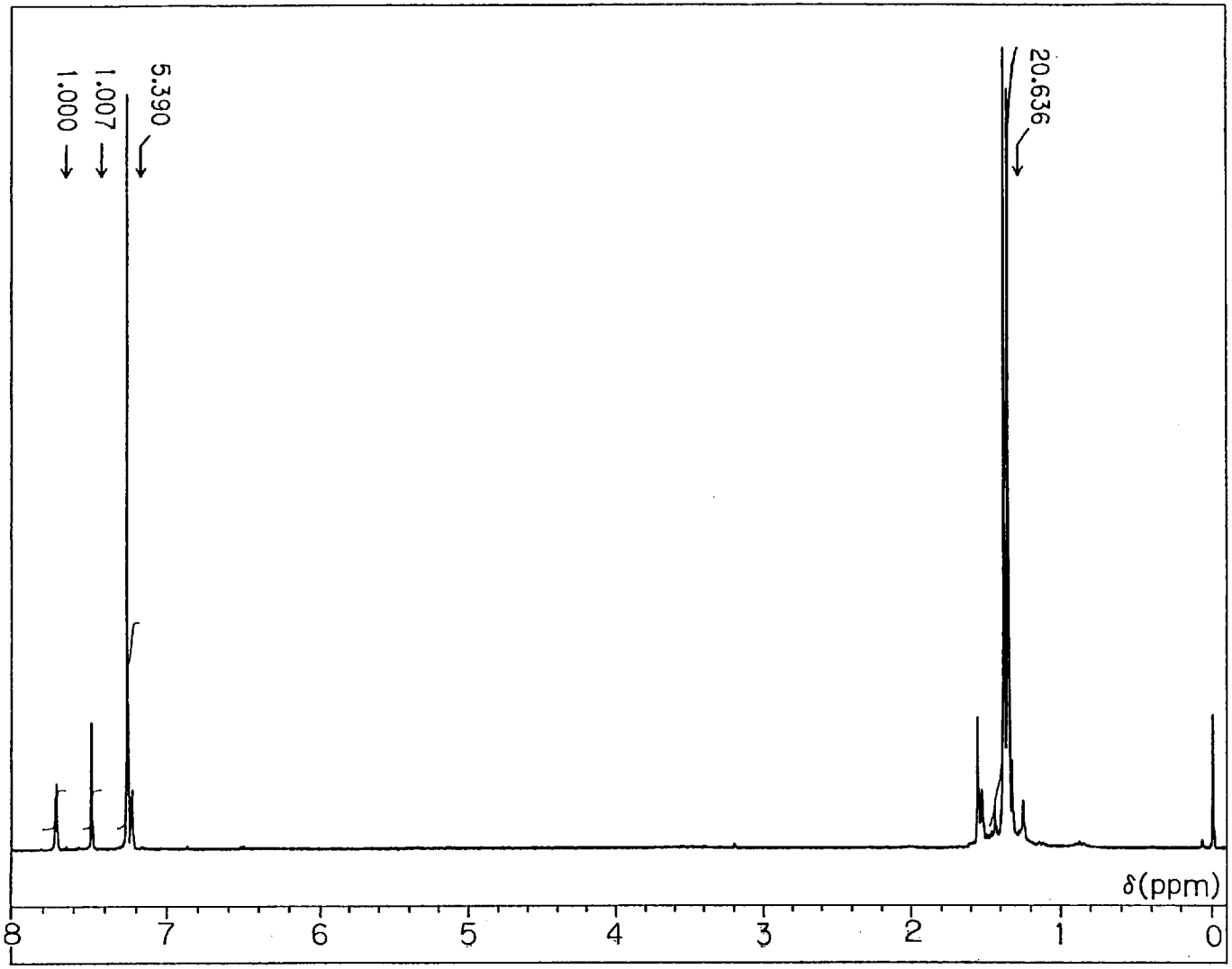
FIG. 1 is a graph showing a $^1$H-NMR spectrum of the quinone derivative represented by the formula (11-1).

The electrophotosensitive material of the present invention will now be described in detail below.

Among the quinone derivatives used as the electron transferring material in the electrophotosensitive material of the present invention, the quinone derivative (terquinone derivative) represented by the general formula (1) is specifically represented by the general formulas (11) and (12):

(11)

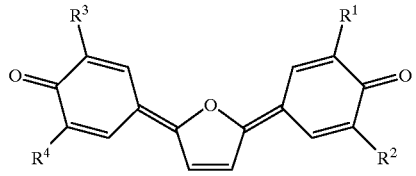

(12)

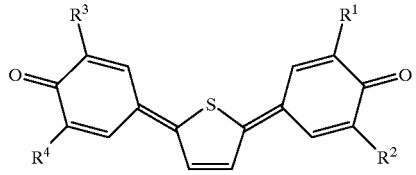

wherein $R^1$ to $R^4$ are as defined above.

In the general formulas (1), (11) and (12), examples of the alkyl group corresponding to $R^1$ to $R^4$ include methyl, ethyl, i-propyl, s-butyl and t-butyl groups. Examples of the aryl group having 6 to 12 carbon atoms include phenyl, naphthyl and biphenyl groups.

The aryl group optionally has an alkyl group having 1 to 4 carbon atoms and examples of the aryl group include (o-, m-, p-)tolyl, (o-, m-, p-)cumenyl, 2,3-zylyl and mesityl. The number and substitution position of the alkyl group with which the aryl group is substituted are not specifically limited.

More specific examples of the quinone derivative (1) wherein the group A is an oxygen atom (general formula (11)) and the group A is a sulfur atom (general formula (12)) are shown in Table 1. The quinone derivative (1), which can be used in the electrophotosensitive material of the present invention, is not limited thereto.

TABLE 1

| | $R^1$ | $R^2$ | $R^3$ | $R^4$ |
|---|---|---|---|---|
| A = 0 | General formula (11) | | | |
| 11-1 | t-Bu | t-Bu | t-Bu | t-Bu |
| 11-2 | Ph | Ph | Ph | Ph |
| 11-3 | Me | Me | t-Bu | t-Bu |
| 11-4 | i-Pr | t-Bu | i-Pr | t-Bu |
| 11-5 | t-Bu | t-Bu | Ph | Ph |
| 11-6 | Ph | Ph | p-$CH_3C_6H_4$ | p-$CH_3C_6H_4$ |
| 11-7 | Ph | Ph | 2-$C_6H_7$ | 2-$C_6H_7$ |
| A = S | General formula (12) | | | |
| 12-1 | t-Bu | t-Bu | t-Bu | t-Bu |
| 12-2 | Ph | Ph | Ph | Ph |
| 12-3 | Me | Me | t-Bu | t-Bu |
| 12-4 | i-Pr | t-Bu | i-Pr | t-Bu |
| 12-5 | t-Bu | t-Bu | Ph | Ph |
| 12-6 | Ph | Ph | p-$CH_3C_6H_4$ | p-$CH_3C_6H_4$ |
| 12-7 | Ph | Ph | 2-$C_6H_7$ | 2-$C_6H_7$ |

In Table 1, "Me" represents a methyl group, "i-Pr" represents an isopropyl group, "t-Bu" represents a t-butyl group, "Ph" represents a phenyl group, "p-$CH_3C_6H_4$" represents a p-tolyl group and "2-$C_6H_7$" represents a 2-naphthyl group, respectively.

In the general formulas (2) and (3), the alkyl group having 1 to 4 carbon atoms, aryl group having 6 to 12 carbon atoms and aryl group having 6 to 12 carbon atoms, which has an alkyl group having 1 to 4 carbon atoms, that correspond to $R^5$ to $R^4$, include the same groups as those for substituent of the quinone derivative represented by the general formula (1).

More specific examples of the quinone derivative (2) and quinone derivative (3) are shown in Table 2. The quinone derivatives (2) and (3), which can be used in the electrophotosensitive material of the present invention, are not limited thereto.

TABLE 2

| | $R^5$ | $R^6$ | $R^7$ | $R^8$ | $R^9$ |
|---|---|---|---|---|---|
| 2-1 | t-Bu | t-Bu | t-Bu | t-Bu | (m = 0) |
| 2-2 | Ph | Ph | Ph | Ph | (m = 0) |
| 2-3 | Me | Me | t-Bu | t-Bu | 2-(t-Bu) |
| 2-4 | i-Pr | t-Bu | i-Pr | t-Bu | (m = 0) |
| 2-5 | t-Bu | t-Bu | Ph | Ph | (m = 0) |
| 2-6 | Ph | Ph | p-$CH_3C_6H_4$ | p-$CH_3C_6H_4$ | (m = 0) |
| 2-7 | Ph | Ph | 2-$C_6H_7$ | 2-$C_6H_7$ | (m = 0) |
| | $R^{10}$ | $R^{11}$ | $R^{12}$ | $R^{13}$ | $R^{14}$ |
| 3-1 | t-Bu | t-Bu | t-Bu | t-Bu | 2-(t-Bu) |
| 3-2 | Ph | Ph | Ph | Ph | (n = 0) |
| 3-3 | Me | Me | t-Bu | t-Bu | 2,7-di(t-Bu) |
| 3-4 | i-Pr | t-Bu | i-Pr | t-Bu | (n = 0) |
| 3-5 | t-Bu | t-Bu | Ph | Ph | (n = 0) |
| 3-6 | Ph | Ph | p-$CH_3C_6H_4$ | p-$CH_3C_6H_4$ | (n = 0) |
| 3-7 | Ph | Ph | 2-$C_6H_7$ | 2-$C_6H_7$ | (n = 0) |

In Table 2, "Me", "i-Pr", "t-Bu", "Ph", "p-$CH_3C_6H_4$" and "2-$C_6H_7$" are as defined above. "2-(t-Bu)" in the column of $R^9$ shows that a t-Bu group is substituted on the 2-position of the naphthalene ring. "2,7-di(t-Bu)" in the column of $R^{14}$ shows that a t-Bu group is substituted on two positions, the 2-position and 7-position of the anthracene ring. "m=0" in the column of $R^9$ and "n=0" in the column of $R^{14}$ show that the substituents $R^9$ and $R^{14}$ are not substituted.

The method of synthesizing the quinone derivative represented by the general formula (1) is shown in the reaction schemes (I) to (IV).

Reaction scheme (I)

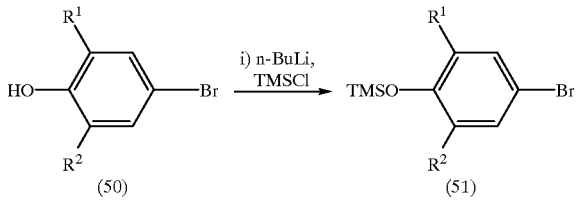

Reaction scheme (II)

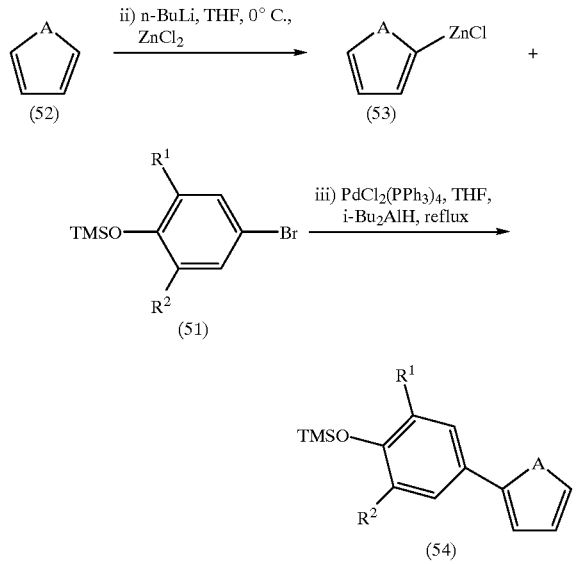

Reaction scheme (III)

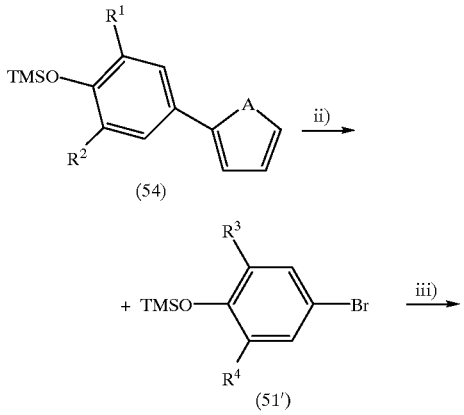

-continued

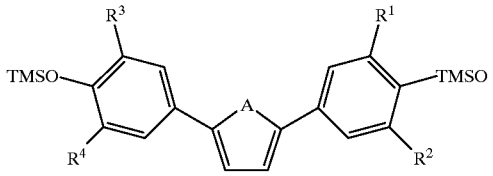

(55)

Reaction Scheme (IV)

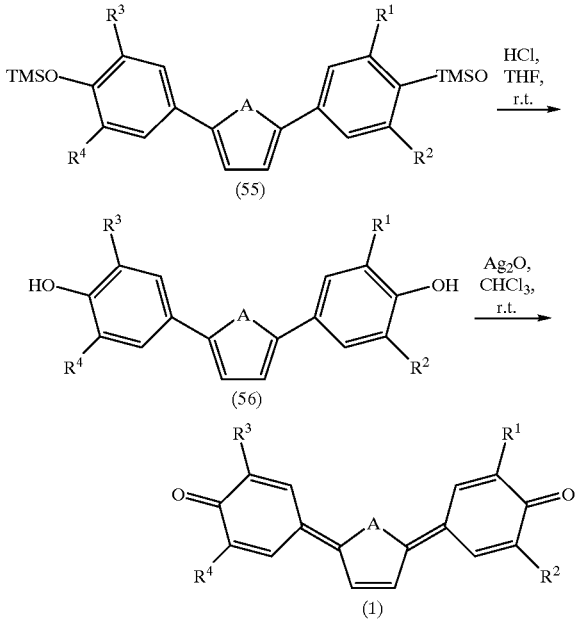

In the schemes (I) to (IV), $R^1$ and $R^2$ are as defined above. "n-Bu" represents a n-butyl group, "TMS" represents a trimethylsilyl group, "THF" represents tetrahydrofuran and "Ph" represents a phenyl group respectively.

The quinone derivative (1) can be synthesized, for example, by the following procedure. The following terms (i) to (iii) correspond to the descriptions in the reaction schemes (I) to (III), respectively.

Reaction scheme (I): First, 4-bromophenol derivative (50) having substituents $R^1$ and $R^2$ at the 2-position and 6-position is used as a starting material and (i) the derivative is reacted with trimethylsilyl chloride under cooling in the presence of n-butyllithium thereby to synthesize a compound (51) wherein a hydroxyl group is substituted with a protective group (trimethylsilyl group).

Reaction scheme (II): Then, (ii) a compound (52) (i.e. furan or thiophene) is reacted with zinc chloride in the presence of n-butyllithium thereby to synthesize a compound (53) and, furthermore, (iii) the compound (53) is reacted with the compound (51) in the presence of diisobutylaluminum hydride (DIBAL-H) thereby to synthesize a compound (54).

Reaction scheme (III): As described in the term (ii), the compound (54) is reacted with zinc chloride in the presence of n-butyllithium and, as described in the term (iii), the reaction product is reacted with the compound (53) in the presence of DIBAL-H to obtain a compound (55).

The compound (53) is synthesized in the same manner as in the reaction scheme (I), except that the substituents $R^1$ and $R^2$ of the compound (50) are replaced by $R^3$ and $R^4$.

Reaction scheme (IV): The compound (55) thus obtained is reacted with an excess amount of concentrated hydrochloric acid to obtain a crude product (56) wherein the protective group (trimethylsilyl group) is eliminated and, furthermore, the crude product (56) is oxidized by an excess amount of silver oxide to obtain a quinone derivative (1).

When using furan as the compound (52) in the reaction scheme (II), a quinone derivative represented by the general formula (11) can be synthesized. When using thiophene, a quinone derivative represented by the general formula (12) can be synthesized.

The method of synthesizing the quinone derivative represented by the general formula (2) is shown in the reaction scheme (V).

Reaction scheme (V)

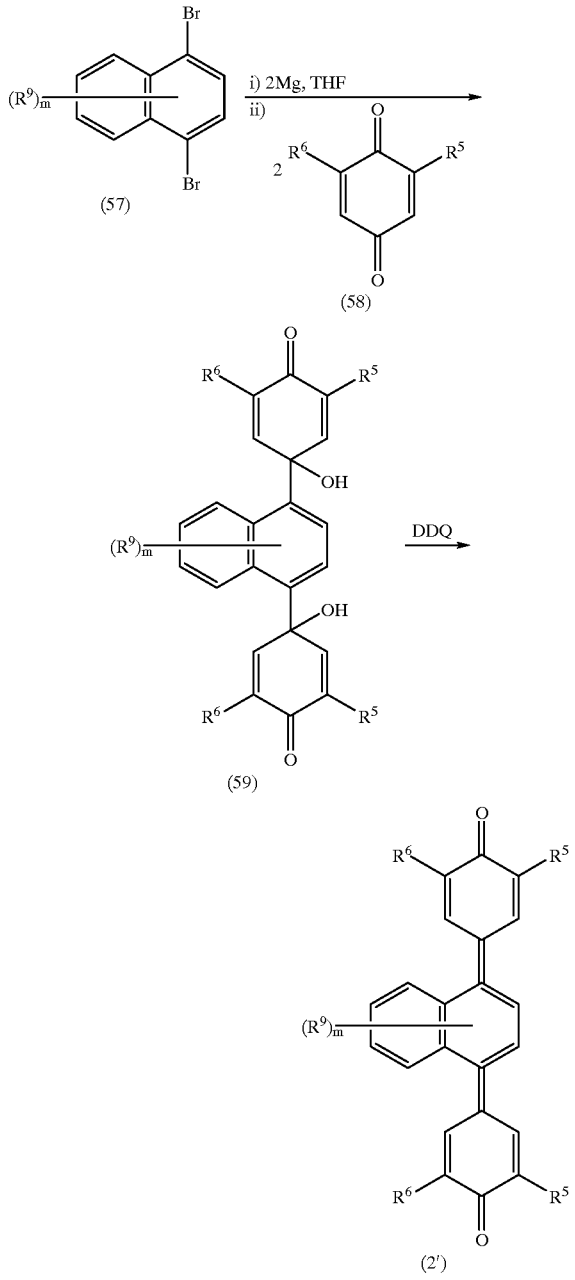

In the scheme (V), $R^5$, $R^6$, $R^9$ and m are as defined above.

The quinone derivative (2) can be synthesized, for example, by the following procedure.

First, a 1,4-dibromonaphthalene derivative (57) is used as a starting material and magnesium is added to a THF solution of the 1,4-dibromonaphthalene derivative (57) to prepare a Grignard reagent. Then, a 1,4-benzoquinone derivative (58) having substituents $R^5$ and $R^6$ at the 2-position and 6-position is added and the mixture is reacted at reflux. After the completion of the reaction, unnecessary substances are removed by filtering the reaction solution. Furthermore, the reaction solution is poured into aqueous hydrochloric acid and extracted with an organic solvent such as chloroform to obtain a compound (59).

Then, an excess amount of DDQ (2,3-dichloro-5,6-dicyano-1,4-benzoquinone) is added to a chloroform solution of the crude product (compound (59)), followed by stirring for several hours. After stirring, the solvent is distilled off and the reaction solution is purified by a silica gel column and then recrystallized from hexane. Thus, a quinone derivative represented by the formula (2').

In the above Synthesis Example, a symmetric quinone derivative wherein the substituents R5 and $R^7$ are the same as the substituents $R^6$ and $R^8$ can be obtained. To synthesize an asymmetric quinone derivative wherein the substituents $R^5$ and $R^7$ are different from the substituents $R^6$ and $R^8$, one equivalent of magnesium is added to prepare a Grignard reagent, which is reacted with one equivalent of the compound (58) [1,4-benzoquinone derivative having substituents $R^5$ and $R^6$ at the 2-position and 6-position] to prepare a Grignard reagent, which is reacted by another compound (58) [1,4-benzoquinone derivative having substituents $R^7$ and $R^8$ at the 2-position and 6-position]. Using two kinds of benzoquinone derivatives having different substituents, the reaction may be allowed to proceed in two stages.

The method of synthesizing the quinone derivative represented by the general formula (3) is shown in the reaction scheme (VI).

Reaction scheme (VI)

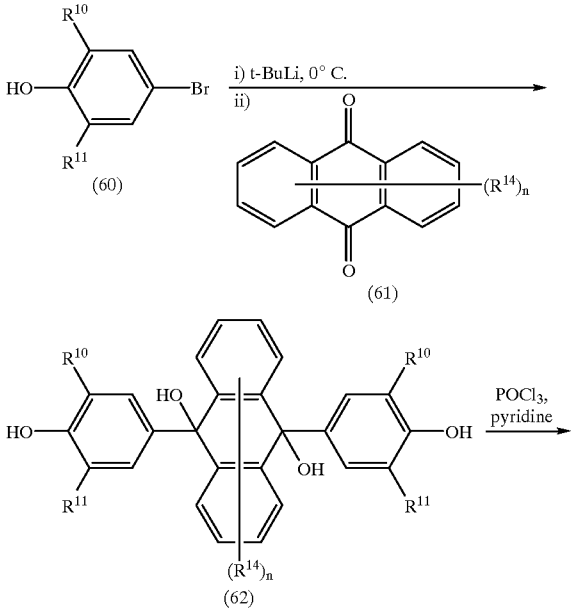

-continued

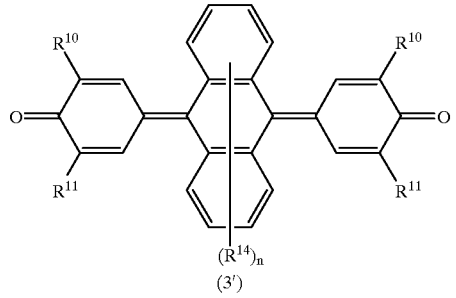

In the scheme (VI), $R^{10}$, $R^{11}$, $R^{14}$ and n are as defined above.

The quinone derivative (3) can be synthesized, for example, by the following procedure.

First, a 4-bromophenol derivative (60) having substituents $R^{10}$ and $R^{11}$ at the 2-position and 6-position is used as a starting material and a t-butyllithium-pentane solution is added to a THF solution of the 4-bromophenol derivative (60) under a nitrogen atmosphere, followed by stirring. Furthermore, an anthraquinone derivative (61) having a substituent $R^{14}$ is added and the mixture is reacted with stirring. After the completion of the reaction, the reaction solution is poured into aqueous hydrochloric acid and extracted with an organic solvent such as chloroform to obtain a compound (62).

A pyridine solution of the compound (62) is heated to 80° C. and phosphorous oxychloride is added, followed by heating with stirring. After the completion of the reaction, the reaction solution is poured into aqueous hydrochloric acid and extracted with an organic solvent such as chloroform. After the reaction solution is dried and the solvent is distilled off, the reaction product is recrystallized from chloroform. Thus, a quinone derivative represented by the formula (3') is obtained.

In the above Synthesis Example, a quinone derivative wherein the substituents $R^{10}$ and $R^{11}$ are symmetric can be obtained. To obtain a quinone derivative wherein the substituents are asymmetric, one carbonyl oxygen of the anthraquinone derivative (61) may be previously substituted with a protective group such as cyanotrimethylsilane [$(CH_3)_3SiCN$].

The electrophotosensitive material of the present invention is produced by forming a photosensitive layer, which contains a quinone derivative represented by any one of the general formulas (1) to (3) as the electron transferring material, on a conductive substrate.

Although the photosensitive layer can be applied to any of the single-layer type and multi-layer type photosensitive materials, the effects by use of the quinone derivatives (1) to (3) remarkably appear in the single-layer type photosensitive material.

The single-layer type photosensitive material is produced by forming a single photosensitive layer containing at least one of quinone derivatives (1) to (3) as the electron transferring material, an electric charge generating material and a binder resin on a conductive substrate. Such a single-layer type photosensitive layer can be applied to any of the positively and negatively charging type photosensitive materials with a single construction, but is preferably used in the positively charging type photosensitive material which does not require a negative corona charge. This single-layer type photosensitive material has advantages such as easy production due to simple structure, inhibition of film defects on formation layers, and improvement in optical characteristics due to fewer interfaces between layers.

Regarding the single-layer type photosensitive material using the quinone derivatives (1) to (3) as the electron transferring material in combination with the hole transferring material having excellent hole transferability, sine an interaction between the quinone derivatives (1) to (3) and the hole transferring material does not occurs, the transfer of electrons and that of holes can be efficiently conducted even if both transferring materials are incorporated in the same photosensitive layer. Therefore, a photosensitive material having high sensitivity can be obtained.

On the other hand, the multi-layer type photosensitive material is produced by laminating an electric charge generating layer containing an electric charge generating material and an electric charge transferring layer containing an electric charge transferring material on a conductive substrate in this or reverse order. Since the electric charge generating layer has a very thin film thickness as compared with the electric charge transferring layer, it is preferred that the electric charge generating layer is formed on the conductive substrate and the electric charge transferring layer is formed thereon to protect the electric charge generating layer.

The charging type (positively or negatively charging) of the multi-layer type photosensitive layer is selected depending on the formation order of the electric charge generating layer and electric charge transferring layer and the kinds of the electric charge transferring material used in the electric charge transferring layer. In the layer construction wherein the electric charge generating layer is formed on the conductive substrate and the electric charge transferring layer is formed thereon, when using the electron transferring material such as quinone derivatives (1) to (3) as the electric charge to transferring material in the electric charge transferring layer, a negatively charging type photosensitive material is obtained. In the layer construction described above, when using the hole transferring material as the electric charge transferring material in the electric charge transferring layer, a positively charging type photosensitive material is obtained. In this case, the electric charge generating layer may contain the electron transferring material.

In the photosensitive material of the present invention, the photosensitive layer may contain the other electron transferring material as the electron acceptor, together with the quinone derivatives (electron transferring materials) represented by the general formulas (1) to (3).

When the redox potential of the electron acceptor is within a range from −0.8 V to −1.4 V, there can be obtained such an effect that the residual potential is drastically lowered thereby to further improve the sensitivity of the photosensitive material.

The electron acceptor (other electron transferring material) whose redox potential is within the range described above efficiently extracts electrons from the gin electric charge generating material (that is, serves as the electron acceptor) on formation of an ion pair of electrons (−) and holes (+) by irradiation with light in the electric charge generating material because its energy level of LUMO (Lowest Unoccupied Molecular Orbital) is lower than that of the electric charge generating material. Therefore, the percentage of elimination of the ion pair due to recombination of the electrons and holes is reduced, thereby improving the efficiency of electric charge generation. The electron acceptor also serves to efficiently transfer the electrons extracted from the electric charge generating material to the quinone derivatives (1) to (3) as the principal electron transferring material. Therefore, in the system using the quinone derivatives (1) to (3) in combination with the electron acceptor, the injection and transfer of the electrons from the electric charge generating material are smoothly conducted thereby further improving the sensitivity of the photosensitive material.

When the redox potential of the electron acceptor (other electron transferring material) is larger than −0.8 V, there is a fear that electrons, which transfer while repeating trapping-detrapping, are fallen into the level where detrapping can not be conducted, thereby causing carrier trapping. The carrier trapping prevents the electrons from transferring, thereby lowering the sensitivity of the photosensitive material. On the other hand, when the redox potential of the electron acceptor is smaller than −1.4 V, there is a fear that the energy level of LUMO becomes larger than that of the electric charge generating material and electrons do not transfer to the other electron transferring material on formation of an ion pair, which does not lead to an improvement in efficiency of the generation of electric charges. It is particularly preferable that the redox potential of the electron acceptor is within a range from −0.85 to −1.00 V in view of the sensitivity of the photosensitive material.

Figure 5:
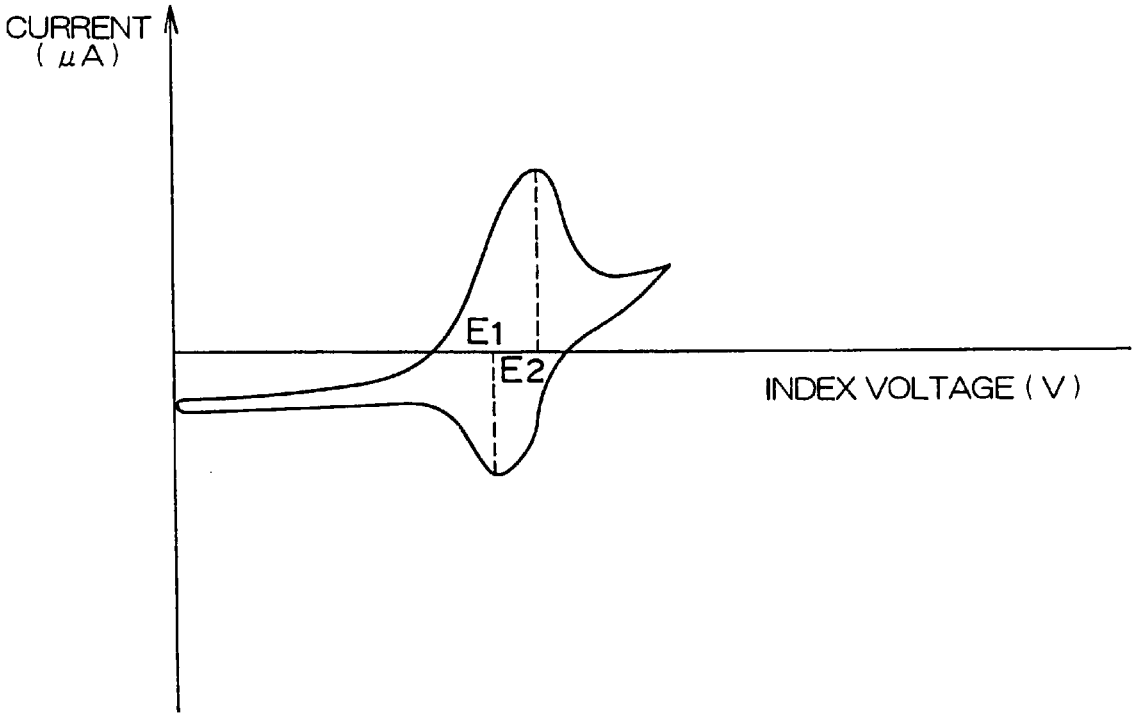
FIG. 5 is a graph showing a relation between the index voltage (V) and the current (πA) for determination of a redox potential.

The redox potential was determined in the following procedure. That is, as shown in FIG. 5, $E_1$ and $E_2$ are determined from the relation between an index voltage (V) and a current ($\mu$A) shown in the same drawing and the redox potential was calculated using the following equation.

$$\text{Redox potential (V)}=(E_1+E_2)/2$$

The index voltage (V) and current ($\mu$A) were measured by three-electrode system cyclic voltammetry using a measuring solution prepared by incorporating the following material.

Electrode: work electrode (glassy carbon electrode), counter electrode (platinum electrode)

Reference electrode: silver nitrate electrode (0.1 mol/L, $AgNO_3$-acetonitrile solution)

Measuring solution: electrolyte (tetra-n-butylammonium perchlorate, 0.1 mol)

Measuring substance: electron transferring material (0.001 mol)

Solvent: $CH_2Cl_2$ (1 ml)

The electron acceptor is not specifically limited as far as it is a compound whose redox potential is within a range from −0.8 to −1.4 V and examples thereof are various compounds having electron acceptability such as anthraquinone derivative, malononitrile derivative, thiopyrane derivative, trinitrothioxanthone derivative, fluorenone derivative (e.g. 3,4,5,7-tetranitro−9-fluorenone), dinitroenthracene derivative, dinitroacridine derivative, nitroanthraquinone derivative and dinitroanthraquinone, including diphenoquinone derivative represented by the general formula (EA1) and benzoquinone derivative represented by the general formula (EA2).

In view of the combination with the quinone derivatives (1) to (3), the diphenoquinone derivative represented by the general formula (EA1) or benzoquinone derivative represented by the general formula (EA2) among the electron acceptors described above is preferably used.

The alkyl group having 1 to 4 carbon atoms and aryl group having 6 to 12 carbon atoms, which correspond to the substituents $R^A$ to $R^H$ in the general formulas (EA1) and (EA2) include the same groups as those for substituents of the quinone derivatives (1) to (3).

Examples of the aralkyl group having 6 to 12 carbon atoms include benzyl, phenethyl, a-methylbenzyl, styryl and cinnamyl groups. Examples of the cycloalkyl group having 3 to 10 carbon atoms include cyclopropyl, cyclobutyl, cyclopentyl, cyclohexyl, cycloheptyl and cyclooctyl groups.

Examples of the alkoxy group having 1 to 4 carbon atoms include methoxy, ethoxy, n-propoxy, i-propoxy, s-butoxy and t-butoxy groups. Examples of the amino group, which optionally has an alkyl group having 1 to 4 carbon atoms, are monomethylamino, dimethylamino, monoethylamino and diethylamino groups, including amino group.

Regarding the substituents $R^A$ to $R^D$ in the general formula (EA1) and substituents $R^E$ to $R^H$ in the general formula (EA2), two or more of them are preferably the same groups but are not limited thereto.

Specific examples of the diphenoquinone derivative (EA1) are 3,3'-dimethyl-5,5'-di(t-butyl)-4,4'-diphenoquinone and 3,5'-dimethyl-3',5-di(t-butyl)-4,4'-diphenoquinone, including 3,5-dimethyl- 3',5,-di(t-butyl)-4,4,-diphenoquinone (redox potential: −0.86 V) represented by the following general formula (EAl- 1) and 3,3',5,5'-tetra (t-butyl)-4,4'-diphenoquinone (redox potential: −0.94 V) represented by the following general formula (EA1- 2).

(EA1-1)

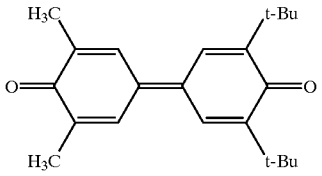

(EA1-2)

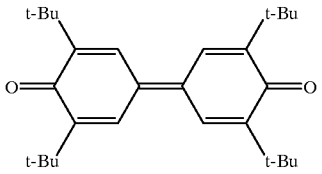

In the formulas described above, "t-Bu" represents a t-butyl group.

Specific examples of the benzoquinone derivative (EA2) include p-benzoquinone (redox potential: −0.81 V) represented by the formula (EA2-1) and 2,6-di(t-butyl)-p-benzoquinone (redox potential: −1.31 V) represented by the formula (EA2-2).

(EA2-1)

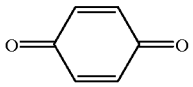

(EA2-2)

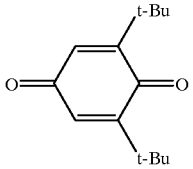

In the formulas described above, "It-Bu" represents a t-butyl group.

In the electrophotosensitive material of the present invention, conventionally known other electron transferring materials may be contained in the photosensitive layer, in addition to the quinone derivatives (1) to (3) and electron acceptors. Examples of the other electron transferring material include malononitrile, thiopyran compound, tetracyanoethylene, 2,4,8-trinitrothioxanthone, dinitrobenzene, dinitroanthracene, dinitroacridine, nitroanthraquinone, succinic anhydride, maleic anhydride and dibromomaleic anhydride.

The electric charge generating material, hole transferring material and binder resin used in the electrophotosensitive material of the present invention are as follows.

Electric Charge Generating Material

As the electric charge generating material used in the present invention, there can be used conventionally known electric charge generating materials, for example, organic photoconductive materials such as metal-free phthalocyanine ($PCH_2$), oxotitanyl phthalocyanine (PcTiO), perylene pigment, bisazo pigment, dithioketopyrrolopyrrole pigment, metal-free naphthalocyanine pigment, metallic naphthalocyanine pigment, squalane pigment, trisazo pigment, indigo pigment, azulenium pigment, cyanine pigment, pyrylium salt pigment, anthanthrone pigment, triphenylmethane pigment, threne pigment, toluidine pigment, pyrrazoline pigment, and quinacridone pigment; and inorganic photoconductive materials such as selenium, selenium-tellurium, selenium-arsenic, cadmium sulfide, and amorphous silicon.

These electric charge generating materials can be uses alone or in combination so that the resulting electrophotosensitive material has an absorption wavelength within a desired range.

A photosensitive material having the sensitivity within a wavelength range of 700 nm or more is required in digital optical image forming apparatuses using a light source such as semiconductor laser, for example, laser beam printer and facsimile. Therefore, phthalocyanine pigments such as metal-free phthalocyanine ($PCH_2$) and oxotitanyl phthalocyanine (PcTiO) are preferably used among the electric charge generating materials described above. The crystal form of the phthalocyanine pigments is not specifically limited and those having different crystal forms can be used.

On the other hand, a photosensitive material having the sensitivity within a visible range is required in analogue optical image forming apparatuses using a white light source such as halogen lamp. Therefore, perylene and bisazo pigments are preferably used.

Hole Transferring Material

Examples of the hole transferring material used in the present invention include nitrogen-containing compounds and condensed polycyclic compounds such as N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenantolylenediamine derivative, oxadiazole compound [e.g. 2,5-di(4-methylaminophenyl)-1,3,4-oxadiazole], styryl compound [e.g. 9-(4-diethylaminostyryl) anthracene], carbazole compound [e.g. poly-N-vinylcarbazole], organopolysilane compound, pyrazoline compound [e.g. 1-phenyl-3-(p-dimethylaminophenyl) pyrazoline], hydrazone compound, indole compound, oxazole compound, isoxazole compound, thiazole compound, thiadiazole compound, imidazole compound, pyrazole compound, and triazole compound.

In the present invention, these hole transferring materials can be used alone or in combination. When using the hole transferring material having a film forming property such as polyvinylcarbazole, a binder resin is not required necessarily.

Binder Resin

The binder resin in which the above respective components are dispersed, there can be used various resins which have hitherto been used in the photosensitive layer. Examples thereof include thermoplastic resins such as styrene-butadiene copolymer, styrene-acrylonitrile copolymer, styrene-maleic acid copolymer, acrylic copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate polymer, ketone resin, polyvinyl butyral resin, polyether resin and polyester resin; crosslinkable thermosetting resins such as silicone resin, epoxy resin, phenol resin, urea resin and melamine resin; and photocurable resins such as epoxy acrylate and urethane acrylate. These binder resins ca be used alone or in combination.

In addition to the above respective components, conventionally known various additives such as oxidation inhibitors, radical scavengers, singlet quenchers, antioxidants (e.g. ultraviolet absorbers), softeners, plasticizers, surfacemodifiers, excipients, thickeners, dispersion stabilizers, waxes, acceptors and donors can be incorporated in the photosensitive layer as far as electrophotographic characteristics are not adversely affected. To improve the sensitivity of the photosensitive layer, for example, known sensitizers such as terphenyl, halonaphthoquinones and acenaphthylene may be used in combination with the electric charge generating material.

The method of producing the electrophotosensitive material of the present invention will be described below.

The single-layer type photosensitive material of aid the present invention is produced by dissolving or dispersing the quinone derivatives (electron transferring materials) represented by the general formulas (1) to (3), an electric charge generating material, a binder resin and, if necessary, a hole transferring material in a proper solvent, coating a conductive substrate with the resulting coating solution, and drying the coating solution.

In the single-layer type photosensitive material, the electric charge generating material may be incorporated in the amount within a range from 0.1 to 50 parts by weight, and preferably from 0.5 to 30 parts by weight, based on 100 parts by weight of the binder resin. The electron transferring material may be incorporated in the amount within a range from 5 to 100 parts by weight, and preferably from 10 to 80 parts by weight, based on 100 parts by weight of the binder resin. The hole transferring material may be incorporated in the amount within a range from 5 to 500 parts by weight, and preferably from 25 to 200 parts by weight, based on 100 parts by weight of the binder resin. When using the electron transferring material and hole transferring material in combination, the total amount of the electron transferring material and hole transferring material is controlled within a range from 20 to 500 parts by weight, and preferably from 30 to 200 parts by weight, based on 100 parts by weight of the binder resin. In case the electron acceptor having a predetermined redox potential is incorporated in the single-layer type photosensitive layer, the amount of the electron acceptor is controlled within a range from 0.1 to 40 parts by weight, and preferably from 0.5 to 20 parts by weight, based on 100 parts by weight of the binder resin.

The thickness of the photosensitive layer in the single-layer type photosensitive material is within a range from about 5 to 100 $\mu$m, and preferably from about 10 to 50 $\mu$m.

The multi-layer type photosensitive material of the present invention is produced by forming an electric charge generating layer containing an electric charge generating material on a conductive substrate by means of deposition or coating, applying a coating solution containing quinone derivatives (electron transferring materials) represented by the general formulas (1) to (3) and a binder resin on the electric charge generating layer, and drying to form an electric charge transferring layer.

In the multi-layer type photosensitive material, the electric charge generating material and binder resin, which constitute the electric charge generating layer, can be incorporated in various ratios, but the electric charge generating material may be incorporated in the amount within a range from 5 to 1000 parts by weight, and preferably from 30 to 500 parts by weight, based on 100 parts by weight of the binder resin. When the hole transferring material is incorporated in the electric charge generating layer, the hole transferring material may be incorporated in the amount within a range from 10 to 500 parts by weight, and preferably from 50 to 200 parts by weight, based on 100 parts by weight of the binder resin.

The electron transferring material and binder resin, which constitute the electric charge transferring layer, can be incorporated in various ratios as far as the transfer of the electric charges is not adversely affected and crystallization does not occur. The electron transferring material is preferably incorporated in the amount within a range from 10 to 500 parts by weight, and particularly from 25 to 200 parts by weight, based on 100 parts by weight of the binder resin, so that the electric charges generated by light irradiation in the electric charge generating layer can be transferred easily. In case the electron acceptor having a predetermined redox potential is incorporated in the electric charge transferring layer, the electron acceptor may be incorporated in the amount within a range from 0.1 to 40 parts by weight, and preferably from 0.5 to 20 parts by weight, based on 100 parts by weight of the binder resin.

With respect to the photosensitive layer in the multi-layer type photosensitive material, the electric charge generating layer has a thickness within a range from about 0.01 to 5 $\mu$m, and preferably from about 0.1 to 3 $\mu$m, while the electric charge transferring layer has a thickness within a range from about 2 to 100 $\mu$m, and preferably from about 5 to 50 $\mu$m.

A barrier layer may be formed between the conductive substrate and photosensitive layer in the single-layer type photosensitive layer, whereas, the barrier layer may be formed between the conductive substrate and electric charge generating layer, or between the conductive substrate and electric charge transferring layer, or between the electric charge generating layer and electric charge transferring layer in the multi-layer type photosensitive material, as far as characteristics of the photosensitive material are not adversely affected. A protective layer may be formed on the surface of the photosensitive material.

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, and ultrasonic dispersing equipment to prepare a dispersion, and then the resulting dispersion is coated by using a known means and dried.

As the solvent for preparing the dispersion, various organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethylformaldehyde, dimethylformamide and dimethyl sulfoxide. These solvents can be used alone, or two or more kinds of them can be used in combination.

To improve the dispersion properties of the electric charge transferring material and electric charge generating material, and the smoothness of the surface of the photosensitive layer, for example, surfactants and leveling agents may be added.

EXAMPLES

The following Reference Examples, Examples and Comparative Examples further illustrate the present invention in detail.

Synthesis of Quinone Derivative

Reference Example 1

(a) After cooling a tetrahydrofuran (THF) solution of 4-bromo-2,6-di-t-butylphenyl (14.4 g, 50 mmol) was cooled to −78° C., a 1.6 M hexane solution (34 mL, 55 mmol) of n-butyllithium was added under a nitrogen atmosphere and trimethylsilyl chloride was further added to obtain 25 g of 4-bromo-2,6-di-t-butylphenol (51') wherein a hydroxyl group is protected with a trimethylsilyl group.

Yield: 70% [see reaction scheme (I)]

(b) After cooling a THF solution of furan (290 mg, 4.2 mmol) to 0° C., a 1.6 M hexane solution (2.8 mL, 4.2 mmol) of n-butyllithium was added under a nitrogen atmosphere and zinc chloride (0.6g, 4.2 mmol) was further added to obtain a THF solution of a compound (53') wherein the group A of the compound represented by the formula (53) is an oxygen atom (O) [see reaction scheme (II)].

(c) To a THF solution of 150 mg of a bistriphenylphosphine-palladium chloride complex charged in another reaction vessel, a 1.0 M hexane solution (0.5 ml, 0.5 mmol) of diisobutlaluminum halide (DIBAL-H) was added to produce palladium having 0 valence as activated species. To said palladium, the compound (51') obtained by the reaction (a) and the compound (53') obtained by the reaction (b) were added and the mixture was refluxed with stirring for two hours.

After the completion of the reaction, the reaction product was poured into water, extracted with chloroform and then recrystallized to obtain a compound (54') wherein the group A of the compound represented by the formula (54) is an oxygen atom [see reaction scheme (II)].

(d) In the same manner as in the term (c), palladium having 0 valence as activated species was produced. To said palladium, the solid compound (54') and the compound (51') obtained by the same reaction (a') were added and the mixture was refluxed with stirring for two hours. Furthermore, the extraction and recrystallization of the product were conducted in the same manner as in the term (c) to obtain a white solid compound (55') wherein the group A of the compound represented by the formula (55) is an oxygen atom [see reaction scheme (III)].

(e) To a mixed solution of THF and water of the solid compound (55'), an excess amount of concentrated hydrochloric acid was added dropwise, followed by stirring for several hours. The reaction product was poured into water, extracted and dried, and then the solvent was distilled off to obtain a crude product (56') wherein the group A of the compound represented by the formula (56) is an oxygen atom.

Furthermore, an excess amount of silver oxide was added to a chloroform solution of the crude product (56') thereby to oxidize the crude product. After the completion of the reaction, the product was collected by filtration, purified by a silica gel column (a ratio of chloroform to hexane is 1/1) and then recrystallized from chloroform to obtain a quinone derivative represented by the formula (11-1) [see reaction scheme (IV)].

Total yield: 20%, deep violet crystal, melting point: 259–260° C.

The $^1$H-NMR spectrum of the quinone derivative(11-1) is shown in FIG. 1.

Reference Example 2

In the same manner as in the terms (a) to (e) of Reference Example 1, except that 50 mmol of 4-bromo-2,6-diphenylphenol was used in place of 4-bromo-2,6-di-t-butylphenol (51') used in the term (a) of Reference Example 1, the reaction was conducted to obtain a quinone derivative represented by the formula (11-2). The melting point of this quinone derivative (11-2) was within a range from 274 to 275° C.

Reference Example 3

In the same manner as in the terms (a) to (e) of Reference Example 1, except that 4.2 mmol of thiophene was used in place of furan used in the term (b) of Reference Example 1, the reaction was conducted to obtain a quinone derivative represented by the formula (12-1).

Total yield: 15%, melting point: 272–274° C.

Figure 2:
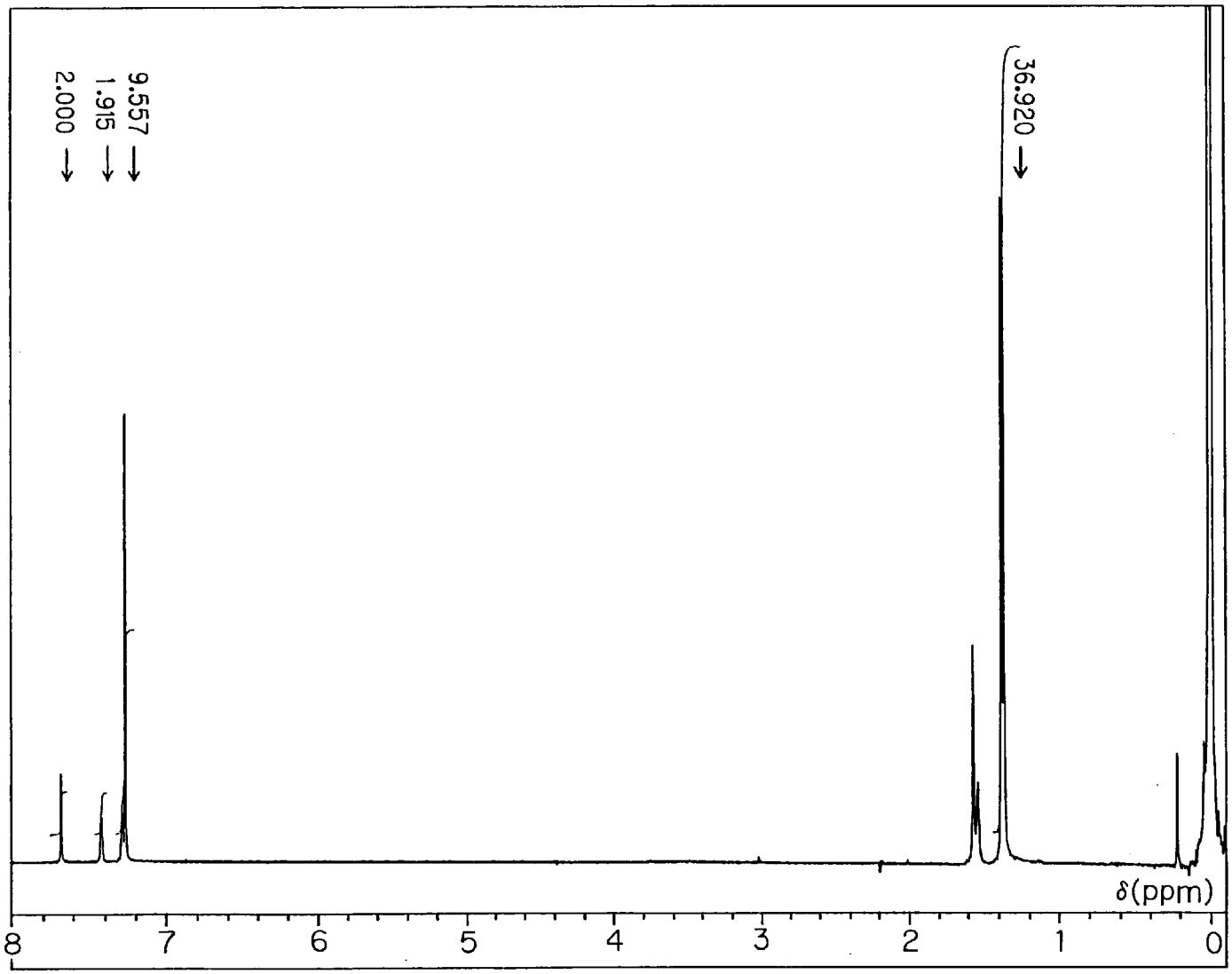
FIG. 2 is a graph showing a $^1$H-NMR spectrum of the quinone derivative represented by the formula (12-1).

The $^1$H-NMR spectrum of the quinone derivative (12-1) is shown in FIG. 2.

Reference Example 4

In the same manner as in the terms (a) to (e) of Reference Example 1, except that 50 mmol of 4-bromo-2,6-diphenylphenol was used in place of 4-bromo-2,6-di-t-butylphenol (51') used in the term (a) of Reference Example 1 and 4.2 mmol of thiophene was used in place of furan used in the term (b) of Reference Example 1, the reaction was conducted to obtain a quinone derivative represented by the formula (12-2). The melting point of this quinone derivative (12-2) was within a range from 287 to 289° C.

Reference Example 5

To a THF solution of 1,4-dibromonaphthalene (3.9 g, 14 mmol), magnesium (1.4 g, 57 mmol) was added under a nitrogen atmosphere to prepare a Grignard reagent. Then, 2,6-di-t-butyl-1,4-benzoquinone (4.08 g, 18 mmol) was added and the mixture was refluxed with stirring for one hour. After the completion of the reaction, In unnecessary substances were removed by filtering the reaction solution. Furthermore, the reaction solution was poured into aqueous hydrochloric acid and extracted with chloroform to obtain a light brown oily compound.

An excess amount of DDQ (2,3-dichloro-5,6-dicyano-1, 4-benzoquinone) was added to a chloroform solution of the crude product, followed by stirring for several hours. After stirring, the solvent was distilled off and the resultant product was purified by a silica gel column and then recrystallized from hexane. Thus, a quinone derivative represented by the formula (2-1) was obtained.

Total yield: 10%, dark green crystal, melting point: 181–183° C.

Figure 3:
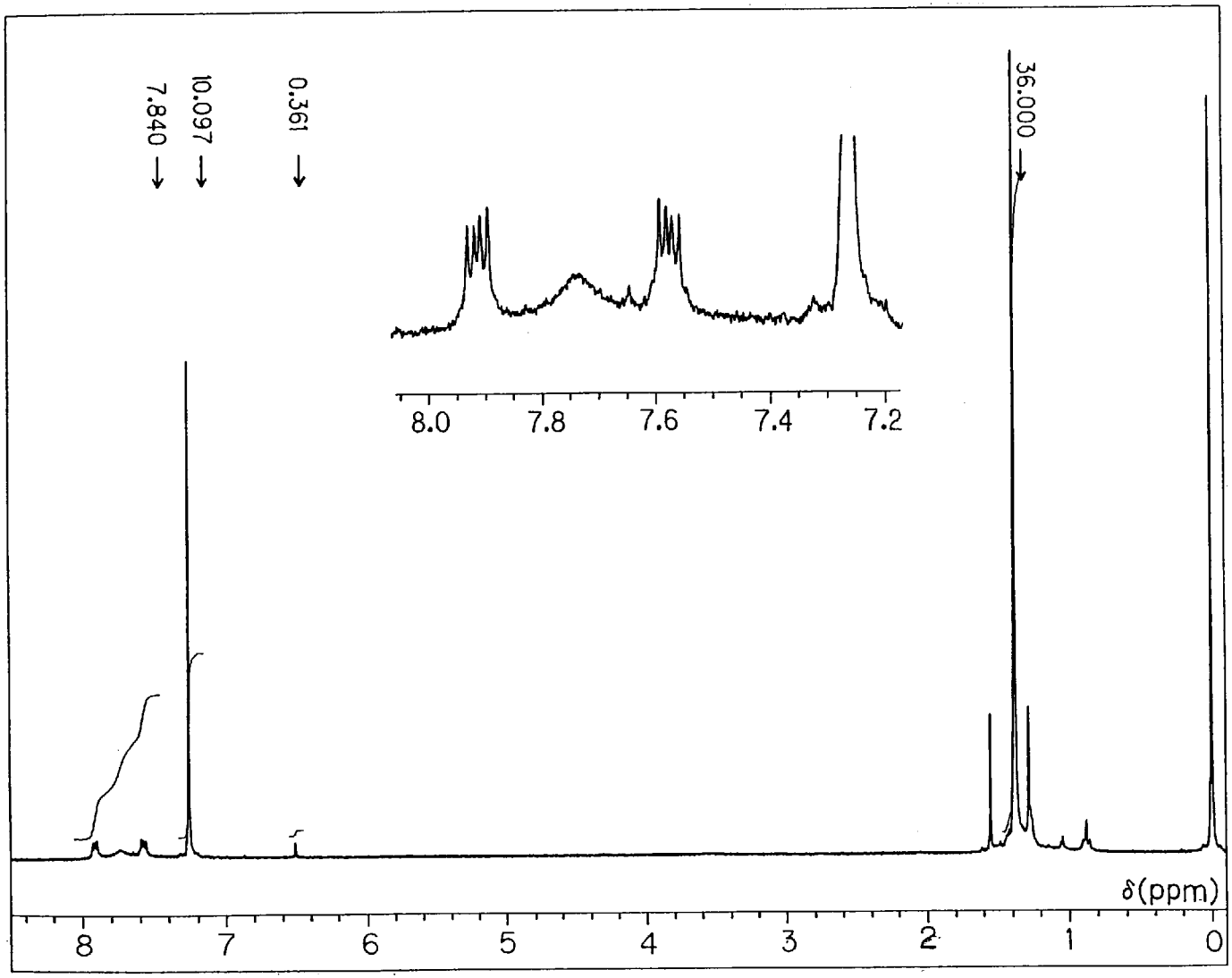
FIG. 3 is a graph showing a $^1$H-NMR spectrum of the quinone derivative represented by the formula (2-1).

The $^1$H-NMR spectrum of the quinone derivative (2-1) is shown in FIG. 3.

Reference Example 6

To a THF solution of 4-bromo-2,6-di-t-butylphenol (5.8g, 20 mmol), a 1.5 M t-butyllithium-pentane solution (40 ml, 60 mmol) was added under a nitrogen atmosphere at 0° C., followed by stirring for one hours. Furthermore, anthraquinone having a t-butyl group at the 2-position (0.3 eq., 6 mmol) was added, followed by stirring for two hours. After the completion of the reaction, the reaction solution was poured into aqueous hydrochloric acid, extracted with chloroform, and then precipitated again to obtain a yellow solid compound.

A pyridine solution of the solid compound (1 g, 1.6 mmol) was heated to 80° C and phosphorous oxychloride (5.8 g, 20 mmol) was added dropwise, followed by heating with stirring for three hours. After the completion of the reaction, the reaction solution was poured into aqueous hydrochloric acid, extracted with chloroform and dried. Then, the solvent was distilled off and the resultant product was recrystallized from chloroform. Thus, a quinone derivative represented by the formula (3-1) was obtained.

Total yield: 55%, orange crystal, melting point: 275° C. (with decomposition)

Figure 4:
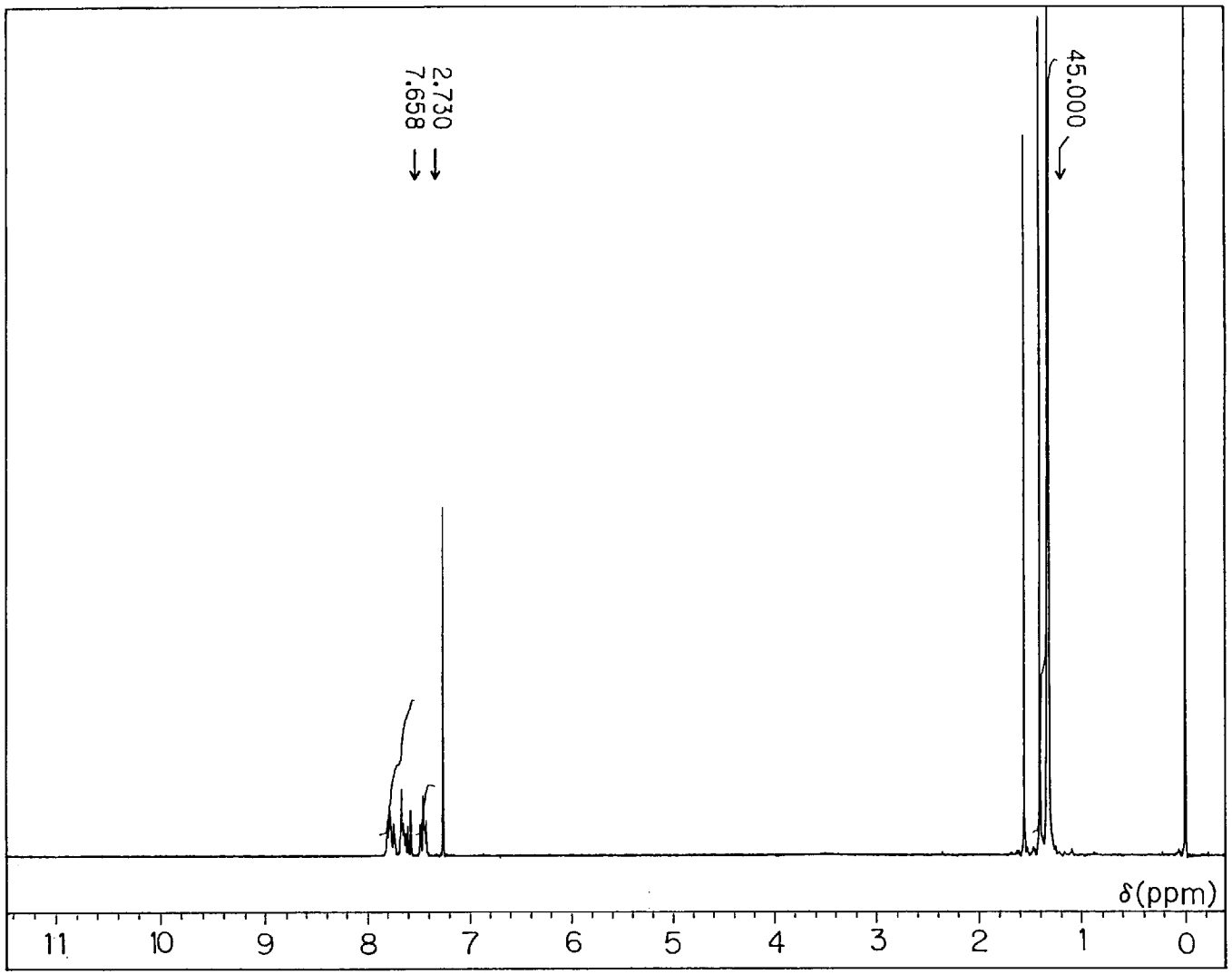
FIG. 4 is a graph showing a $^1$H-NMR spectrum of the quinone derivative represented by the formula (3-1).

The $^1$H-NMR spectrum of the quinone derivative (3-1) is shown in FIG. 4.

The chemical structures of the quinone derivatives obtained in Reference Examples 1 to 6 are as follows.

(11-1)

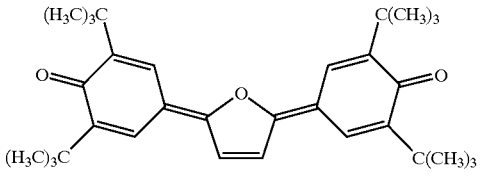

-continued (11-2)

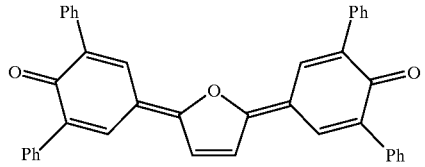

(12-1)

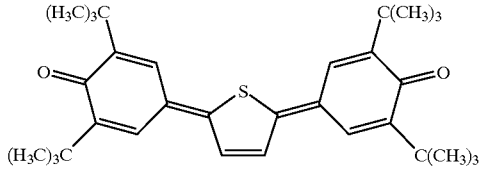

(12-2)

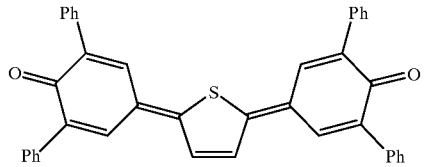

(2-1)

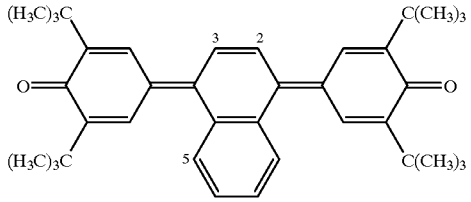

(3-1)

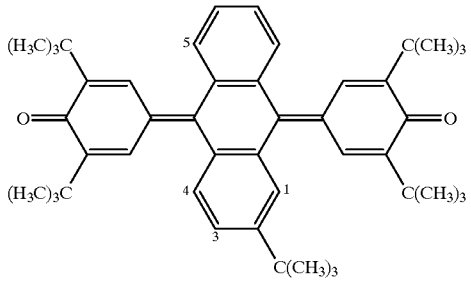

wherein "Ph" represents a phenyl group

Production of Electrophotosensitive Material

Example 1

A metal-free phthalocyanine pigment ($PcH_2$) was used as the electric charge generating material and a phenylenediamine derivative (4Me-PDA) represented by the formula (11-1):

(6)

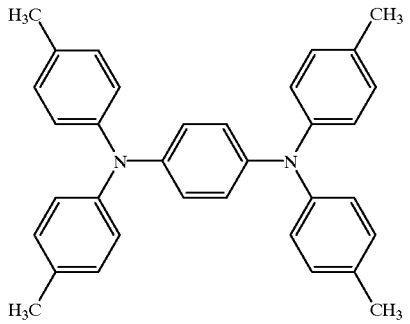

was used as the hole transferring material and, furthermore, a quinone derivative represented by the formula (11-1) was used as the electron transferring material.

5 Parts by weight of the electric charge generating material, 50 parts by weight of the hole transferring material, 30 parts by weight of the electron transferring material, 100 parts by weight of the binder resin (polycarbonate) and 800 parts by weight of the solvent (tetrahydrofuran) were mixed and dispersed using a ball mill for 50 hours to prepare a coating solution for single-layer type photosensitive layer. Then, a conductive substrate (alumina tube) was coated with the coating solution by a dip coating method, followed by hot-air drying at 100° C. for 60 minutes to produce a single-layer type electrophotosensitive material (for digital light source) having a photosensitive layer of 15 to 20 $\mu$m in film thickness.

Example 2

In the same manner as in Example 1, except that an oxotitanylphthalocyanine pigment (PcTiO) was used as the electric charge generating material, a single-layer type electrophotosensitive material (for digital light source) was produced.

Example 3

A metal-free phthalocyanine pigment ($PcH_2$) was used as the electric charge generating material and a quinone derivative represented by the formula (11-1) was used as the electron transferring material.

100 Parts by weight of the electric charge generating material, 100 parts by weight of the binder resin (polyvinyl butyral) and 2000 parts by weight of the solvent (tetrahydrofuran) were mixed and dispersed using a ball mill for 50 hours to prepare a coating solution for electric charge generating layer. Then, a conductive substrate (alumina tube) was coated with the coating solution by a dip coating method, followed by hot-air drying at 100° C. for 60 minutes to produce an electric charge generating layer having a film thickness of 1 $\mu$m.

Then, 100 parts by weight of the electron transferring material, 100 parts by weight of the binder resin (polycarbonate) and 800 parts by weight of the solvent (toluene) were mixed and dispersed using a ball mill for 50 hours to prepare a coating solution for electron transferring layer. Then, the electric charge generating layer was coated with the coating solution by a dip coating method, followed by hot-air drying at 100° C. for 60 minutes to produce form an electric charge transferring layer of 20 $\mu$m in film thickness, thus obtaining a multi-layer type electrophotosensitive material (for digital light source).

Example 4

In the same manner as in Example 1, except that a perylene pigment represented by the formula (7):

(7)

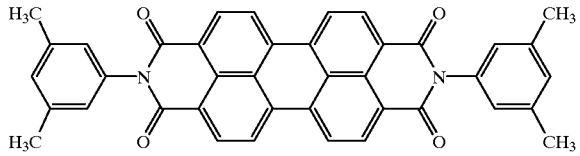

was used as the electric charge generating material, a single-layer type electrophotosensitive material (for a analog light source) was produced.

Example 5

In the same manner as in Example 3, except that the same perylene pigment as that used in Example 4 was used as the electric charge generating material, a multi-layer type electrophotosensitive material (for analog light source) was produced.

Examples 6 to 9

A metal-free phthalocyanine pigment ($PcH_2$) was used as the electric charge generating material and the same benzidine derivative represented by the formula (HT1-1) as that used in Example 1 was used as the hole transferring material and, furthermore, a quinone derivative represented by the formula (11-1) was used as the electron transferring material.

A benzoquinone derivative represented by the formula (EA2-1) (Example 6), a benzoquinone derivative represented by the formula (EA2-2) (Example 7), a diphenoquinone derivative represented by the formula (EA1-1) (Example 8) or a diphenoquinone derivative represented by the formula (EA1-2) (Example 9) was respectively used as the electron acceptor having a predetermined redox potential.

5 Parts by weight of the electric charge generating material, 50 parts by weight of the hole transferring material, 30 parts by weight of the electron transferring material, 10 parts by weight of the electron acceptor, 100 parts by weight of the binder resin (polycarbonate) and 800 parts by weight of the solvent (tetrahydrofuran) were mixed and dispersed using a ball mill for 50 hours to prepare a coating solution for single-layer type photosensitive layer. Then, a conductive substrate (alumina tube) was coated with the coating solution by a dip coating method, followed by hot-air drying at 100° C. for 60 minutes to produce a single-layer type electrophotosensitive material (for digital light source) having a photosensitive layer of 15 to 20 $\mu$m in film thickness.

Among the photosensitive materials obtained in Examples 1 to 9, the photosensitive materials for digital light source were subjected to the following electrical characteristics test (A), while the photosensitive materials for analog light source were subjected to the following electrical characteristics test (B). Then, electrical characteristics of the respective photosensitive materials were evaluated.

Electrical Characteristics Test (A)

Using a drum sensitivity tester (manufactured by GENTEC Co.), a voltage was applied on the surface of each photosensitive material to charge the surface at +700 V. Then, monochromic light having a wavelength of 780 nm (half-width: 20 nm, light intensity: 16 $\mu$W/cm$^2$) from white light of a halogen lamp as an exposure light source through a band-pass filter was irradiated on the surface of each photosensitive material (irradiation time: 80 mseconds) and a surface potential at the time at which 330 mseconds have passed since the beginning of exposure was measured as a residual potential $V_r$ (unit: V).

Electrical Characteristics Test (B)

In the same manner as in the electrical characteristics test (A) described above, except that white light (light intensity: 147 $\mu$W/cm$^2$) from a halogen lamp was used as the exposure light source and the irradiation time was adjusted to 50 mseconds, a residual potential $V_r$ (V) was measured.

The smaller the value of the residual potential $V_r$, the better the sensitivity.

Examples 10 to 18

In the same manner as in Examples 1 to 9, except that a quinone derivative represented by the formula (11-2) was used, electrophotosensitive materials were produced.

Examples 10 and 11 are single-layer type photosensitive materials for digital light source, Example 12 is a multi-layer type photosensitive material for digital light source, Example 13 is a single-layer type photosensitive material for analog light source, Example 14 is a multi-layer type photosensitive material for analog light source, and Examples 15 to 18 are single-layer type photosensitive materials for digital light source, which contain an electron acceptor.

Examples 19 to 27

In the same manner as in Examples 1 to 9, except that a quinone derivative represented by the formula (12-1) was used, electrophotosensitive materials were produced.

Examples 19 and 20 are single-layer type photosensitive materials for digital light source, Example 21 is a multi-layer type photosensitive material for digital light source, Example 22 is a single-layer type photosensitive material for analog light source, Example 23 is a multi-layer type photosensitive material for analog light source, and Examples 24 to 27 are single-layer type photosensitive materials for digital light source, which contain an electron acceptor.

Examples 28 to 36

In the same manner as in Examples 1 to 9, except that a quinone derivative represented by the formula (12-2) was used, electrophotosensitive materials were produced.

Examples 28 and 29 are single-layer type photosensitive materials for digital light source, Example 30 is a multi-layer type photosensitive material for digital light source, Example 31 is a single-layer type photosensitive material for analog light source, Example 32 is a multi-layer type photosensitive material for analog light source, and Examples 33 to 36 are single-layer type photosensitive materials for digital light source, which contain an electron acceptor.

Examples 37 to 45

In the same manner as in Examples 1 to 9, except that a quinone derivative represented by the formula (2-1) was used, electrophotosensitive materials were produced.

Examples 37 and 38 are single-layer type photosensitive materials for digital light source, Example 39 is a multi-layer type photosensitive material for digital light source, Example 40 is a single-layer type photosensitive material for analog light source, Example 41 is a multi-layer type photosensitive material for analog light source, and Examples 42 to 45 are single-layer type photosensitive materials for digital light source, which contain an electron acceptor.

Examples 46 to 54

In the same manner as in Examples 1 to 9, except that a quinone derivative represented by the formula (3-1) was used, electrophotosensitive materials were produced.

Examples 46 and 47 are single-layer type photosensitive materials for digital light source, Example 48 is a multi-layer type photosensitive material for digital light source, Example 49 is a single-layer type photosensitive material for analog light source, Example 50 is a multi-layer type photosensitive material for analog light source, and Examples 51 to 54 are single-layer type photosensitive materials for digital light source, which contain an electron acceptor Comparative Examples 1 and 10

In the same manner as in Example 1, except that a naphthoquinone derivative represented by the formula (EA3-1):

(EA3-1)

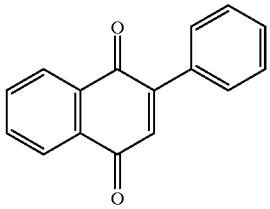

(Comparative Example 1) or a diphenoquinone derivative represented by the formula (EA1-1) (Comparative Example 10) was used as the electron transferring material, single-layer type electrophotosensitive materials (for digital light source) were produced.

Comparative Examples 2 and 11

In the same manner as in Example 2, except that a naphthoquinone derivative represented by the formula (EA3-1) (Comparative Example 2) or a diphenoquinone derivative represented by the formula (EA1-1) (Comparative Example 11) was used as the electron transferring material, single-layer type electrophotosensitive materials (for digital light source) were produced.

Comparative Examples 3 and 13

In the same manner as in Example 3, except that a naphthoquinone derivative represented by the formula (EA3-1) (Comparative Example 3) or a diphenoquinone derivative represented by the formula (EA1-1) (Comparative Example 13) was used as the electron transferring material, single-layer type electrophotosensitive materials (for digital light source) were produced.

Comparative Examples 4 and 14

In the same manner as in Example 4, except that a naphthoquinone derivative represented by the formula (EA3-1) (Comparative Example 4) or a diphenoquinone derivative represented by the formula (EA1-1) (Comparative Example 14) was used as the electron transferring material, single-layer type electrophotosensitive materials (for analog light source) were produced.

Comparative Examples 5 and 16

In the same manner as in Example 5, except that a naphthoquinone derivative represented by the formula (EA3-1) (Comparative Example 5) or a diphenoquinone derivative represented by the formula (EA1-1) (Comparative Example 16) was used as the electron transferring material, multi-layer type electrophotosensitive materials (for analog light source) were produced.

Comparative Examples 6 to 9

In the same manner as in Examples 6 to 9, except that a naphthoquinone derivative represented by the formula (EA3-1) was used as the electron transferring material, single-layer type electrophotosensitive materials (for digital light source) were produced.

As the other electron transferring material having a predetermined redox potential, a benzoquinone derivative represented by the formula (EA2-1) (Comparative Example 6), a benzoquinone derivative represented by the formula (EA2-2) (Comparative Example 7), a diphenoquinone derivative represented by the formula (EA1-1) (Comparative Example 8) or a diphenoquinone derivative represented by the formula (EA1-2) (Comparative Example 9) was used.

Comparative Example 12

In the same manner as in Example 1, except that the electron transferring material was not incorporated, a single-layer type electrophotosensitive material (for digital light source) was produced.

Comparative Example 15

In the same manner as in Example 4, except that the electron transferring material was not incorporated, a single-layer type electrophotosensitive material (for analog light source) was produced.

Among the photosensitive materials obtained in Examples 10 to 54 and Comparative Examples 1 to 16, the photosensitive materials for digital light source were subjected to the above electrical characteristics test (A), while the photosensitive materials for analog light source were subjected to the above electrical characteristics test (B). Then, electrical characteristics of the respective photosensitive materials were evaluated.

With respect to photosensitive materials obtained in Examples 10 to 54 and Comparative Examples 1 to 16, the kinds of the electric charge generating material, hole transferring material, electron transferring material and other electron transferring material having a predetermined redox potential are shown in Tables 3 to 7, together with the test results of the electrical characteristics. The kinds of the electric charge generating material, electron transferring material and other electron acceptor were shown by the number with which each compound is provided (provided that the perylene pigment represented by the formula (7) was shown by "perylene").

TABLE 3

| | Electric charge generating material | Hole transferring material | Electron transferring material | Electron acceptor | $V_r$ (V) |
|---|---|---|---|---|---|
| Example 1 | $PcH_2$ | Contained | 11-1 | — | 192 |
| Example 2 | PcTiO | Contained | 11-1 | — | 198 |
| Example 3 | $PcH_2$ | — | 11-1 | — | 285 |
| Example 4 | Perylene | Contained | 11-1 | — | 230 |
| Example 5 | Perylene | — | 11-1 | — | 312 |
| Example 6 | $PcH_2$ | Contained | 11-1 | EA2-1 | 168 |

TABLE 3-continued

| | Electric charge generating material | Hole transferring material | Electron transferring material | Electron acceptor | $V_r$ (V) |
|---|---|---|---|---|---|
| Example 7 | $PcH_2$ | Contained | 11-1 | EA2-2 | 167 |
| Example 8 | $PcH_2$ | Contained | 11-1 | EA1-1 | 157 |
| Example 9 | $PcH_2$ | Contained | 11-1 | EA1-2 | 162 |
| Example 10 | $PcH_2$ | Contained | 11-2 | — | 196 |
| Example 11 | PcTiO | Contained | 11-2 | — | 200 |
| Example 12 | $PcH_2$ | — | 11-2 | — | 287 |
| Example 13 | Perylene | Contained | 11-2 | — | 233 |
| Example 14 | Perylene | — | 11-2 | — | 315 |
| Example 15 | $PcH_2$ | Contained | 11-2 | EA2-1 | 171 |
| Example 16 | $PcH_2$ | Contained | 11-2 | EA2-2 | 169 |
| Example 17 | $PcH_2$ | Contained | 11-2 | EA1-1 | 160 |
| Example 18 | $PcH_2$ | Contained | 11-2 | EA1-2 | 163 |

TABLE 4

| | Electric charge generating material | Hole transferring material | Electron transferring material | Electron acceptor | $V_r$ (V) |
|---|---|---|---|---|---|
| Example 19 | $PcH_2$ | Contained | 12-1 | — | 190 |
| Example 20 | PcTiO | Contained | 12-1 | — | 195 |
| Example 21 | $PcH_2$ | — | 12-1 | — | 280 |
| Example 22 | Perylene | Contained | 12-1 | — | 220 |
| Example 23 | Perylene | — | 12-1 | — | 302 |
| Example 24 | $PcH_2$ | Contained | 12-1 | EA2-1 | 165 |
| Example 25 | $PcH_2$ | Contained | 12-1 | EA2-2 | 160 |
| Example 26 | $PcH_2$ | Contained | 12-1 | EA1-1 | 146 |
| Example 27 | $PcH_2$ | Contained | 12-1 | EA1-2 | 152 |
| Example 28 | $PcH_2$ | Contained | 12-2 | — | 193 |
| Example 29 | PcTiO | Contained | 12-2 | — | 198 |
| Example 30 | $PcH_2$ | — | 12-2 | — | 282 |
| Example 31 | Perylene | Contained | 12-2 | — | 225 |
| Example 32 | Perylene | — | 12-2 | — | 306 |
| Example 33 | $PcH_2$ | Contained | 12-2 | EA2-1 | 167 |
| Example 34 | $PcH_2$ | Contained | 12-2 | EA2-2 | 164 |
| Example 35 | $PcH_2$ | Contained | 12-2 | EA1-1 | 150 |
| Example 36 | $PcH_2$ | Contained | 12-2 | EA1-2 | 154 |

TABLE 5

| | Electric charge generating material | Hole transferring material | Electron transferring material | Electron acceptor | $V_r$ (V) |
|---|---|---|---|---|---|
| Example 37 | $PcH_2$ | Contained | 2-1 | — | 175 |
| Example 38 | PcTiO | Contained | 2-1 | — | 189 |
| Example 39 | $PcH_2$ | — | 2-1 | — | 278 |
| Example 40 | Perylene | Contained | 2-1 | — | 220 |
| Example 41 | Perylene | — | 2-1 | — | 285 |
| Example 42 | $PcH_2$ | Contained | 2-1 | EA2-1 | 150 |
| Example 43 | $PcH_2$ | Contained | 2-1 | EA2-2 | 156 |
| Example 44 | $PcH_2$ | contained | 2-1 | EA1-1 | 142 |
| Example 45 | $PcH_2$ | Contained | 2-1 | EA1-2 | 148 |

TABLE 6

| | Electric charge generating material | Hole transferring material | Electron transferring material | Electron acceptor | $V_r$ (V) |
|---|---|---|---|---|---|
| Example 46 | $PcH_2$ | contained | 3-1 | — | 190 |
| Example 47 | PcTiO | contained | 3-1 | — | 193 |
| Example 48 | $PcH_2$ | | 3-1 | — | 284 |
| Example 49 | Perylene | contained | 3-1 | — | 227 |

TABLE 6-continued

| | Electric charge generating material | Hole transferring material | Electron transferring material | Electron acceptor | $V_r$ (V) |
|---|---|---|---|---|---|
| Example 50 | Perylene | | 3-1 | — | 303 |
| Example 51 | $PcH_2$ | contained | 3-1 | EA2-1 | 165 |
| Example 52 | $PcH_2$ | contained | 3-1 | EA2-2 | 165 |
| Example 53 | $PcH_2$ | contained | 3-1 | EA1-1 | 156 |
| Example 54 | $PcH_2$ | Contained | 3-1 | EA1-2 | 162 |

TABLE 7

| | Electric charge generating material | Hole transferring material | Electron transferring material | Electron acceptor | $V_r$ (V) |
|---|---|---|---|---|---|
| Comp. Example 1 | $PCH_2$ | contained | EA3-1 | — | 305 |
| Comp. Example 2 | PcTiO | contained | EA3-1 | — | 330 |
| Comp. Example 3 | $PcH_2$ | — | EA3-1 | — | 409 |
| Comp. Example 4 | Perylene | Contained | EA3-1 | — | 375 |
| Comp. Example 5 | Perylene | — | EA3-1 | — | 455 |
| Comp. Example 6 | $PcH_2$ | contained | EA3-1 | EA2-1 | 295 |
| Comp. Example 7 | $PCH_2$ | contained | EA3-1 | EA2-2 | 290 |
| Comp. Example 8 | $PcH_2$ | contained | EA3-1 | EA1-1 | 290 |
| Comp. Example 9 | $PcH_2$ | contained | EA3-1 | EA1-2 | 288 |
| Comp. Example 10 | $PcH_2$ | contained | EA1-1 | — | 220 |
| Comp. Example 11 | PcTiO | contained | EA1-1 | — | 478 |
| Comp. Example 12 | $PcH_2$ | — | EA1-1 | — | 242 |
| Comp. Example 13 | $PcH_2$ | — | EA1-1 | — | 346 |
| Comp. Example 14 | Perylene | contained | EA1-1 | — | 294 |
| Comp. Example 15 | Perylene | contained | — | — | 521 |
| Comp. Example 16 | Perylene | — | EA1-1 | — | 386 |

As is apparent from Tables 3 to 7, any of the photosensitive materials using the quinone derivatives represented by the general formulas (1) to (3) of Examples 1 to 54 exhibits a small residual potential $V_r$ as compared with the corresponding photosensitive materials of Comparative Examples 1 to 16 and is superior in sensitivity.

The photosensitive materials using the quinone derivatives (1) to (3) in combination with the other electron transferring material having a predetermined redox potential exhibit a smaller residual potential $V_r$ an is superior in sensitivity.

With respect to the photosensitive materials obtained in Examples 1 to 54, the state of formation of a dry film was observed by a scanning electron microscope (SEM). As a result, any of the photosensitive materials showed good state of formation of a film. Accordingly, it has been confirmed that the quinone derivatives (1) to (3) have sufficient compatibility with the binder resin.

These electrophotosensitive materials have high sensitivity because they are provided with a photosensitive layer containing the quinone derivatives (1) to (3). Accordingly, these electrophotosensitive materials has specific operation/effect capable of contributing to realize speed up and high performance of various image forming apparatuses such as electrostatic copying machine and laser printer.

The disclosures of Japanese Patent Application Nos.11-339516 and 2000-133637, filed on Nov. 30, 1999 and May 2, 2000, respectively are incorporated herein by reference.

What is claimed is:

1. An electrophotosensitive material comprising a conductive substrate and a single layer photosensitive material containing an electric charge generating material and an electron transferring material formed on the conductive substrate, wherein the single layer photosensitive material contains as the electron transferring material a quinone derivative represented by the general formula (2):

(2)

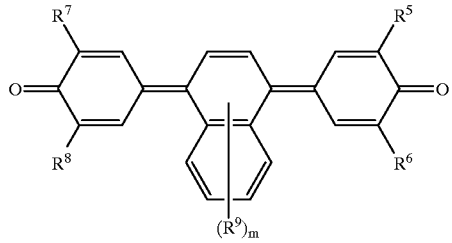

wherein $R^5$, $R^6$, $R^7$, $R^8$ and $R^9$ are the same or different and each represents an alkyl group having 1 to 4 carbon atoms, or an aryl group having 6 to 12 carbon atoms, which optionally has an alkyl group having 1 to 4 carbon atoms, and m represents an integer of 0 to 4, wherein the single layer photosensitive material is produced by dispersing at least the quinone derivative represented by the general formula (2) and the electric charge generating material in a binder resin on the conductive substrate.

2. The electrophotosensitive material according to claim 1, wherein the single layer photosensitive material contains the quinone derivative of the general formula (2) wherein $R^5$ is an isopropyl group, a t-butyl group or a phenyl group, $R^6$ is a methyl group, a t-butyl group, or a phenyl group, $R^7$ is ah isopropyl group, a t-butyl group, a phenyl group, a p-tolyl group or a 2-naphthly group, $R^8$ is a t-butyl group, a phenyl group, a p-tolyl group or a 2-naphthyl group, and m in $(R^9)m$ is 0 or $(R^9)m$ is a group in which a t-butyl group is substituted on the 2-position of a naphthalene ring.

3. The electrophotosensitive material according to claim 1, wherein the single layer photosensitive material contains the quinone derivative represented by the general formula (2) and an electron acceptor having a redox potential of −0.8 to −1.4 V.

4. The electrophotosensitive material according to claim 3, wherein the electron acceptor is a diphenoquinone derivative represented by the general formula (EA1)

(EA1)

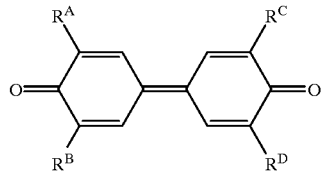

wherein $R^A$, $R^B$, $R^C$ and $R^D$ are the same or different and each represents a hydrogen atom, an alkyl group having 1 to 4 carbon atoms, an aryl group having 6 to 12 carbon atoms, an aralkyl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms, or a benzoquinone derivative represented by the general formula (EA2);

(EA2)

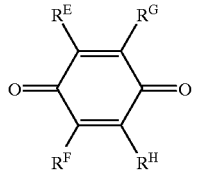

wherein $R^E$, $R^F$, $R^G$, and $R^H$ are the same or different and each represents a hydrogen atom, an alkyl group having 1 to 4 carbon atoms, an aryl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms.

5. An electrophotosensitive material comprising a conductive substrate and a single layer photosensitive material containing an electric charge generating material and an electron transferring material formed on the conductive substrate, wherein the single layer photosensitive material contains as the electron transferring material a quinone derivative represented by the general formula (3):

(3)

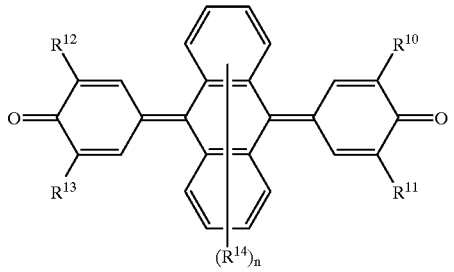

wherein $R^{10}$, $R^{11}$, $R^{12}$, $R^{13}$, and $R^{14}$ are the same or different and each represents an alkyl group having 1 to 4 carbon atoms, or an aryl group having 6 to 12 carbon atoms, which optionally has an alkyl group having 1 to 4 carbon atoms, and n represents an integer of 0 to 4, wherein the single layer photosensitive material is produced by dispersing at least the quinone derivative represented by the general formula (3) and the electric charge generating material in a binder resin on the conductive substrate.

6. The electrophotosensitive material according to claim 5, wherein the single layer photosensitive material contains the quinone derivative of the general formula (3) wherein $R^{10}$ is an isopropyl group, a t-butyl or a phenyl group, $R^{11}$ is a methyl group, a t-butyl group or a phenyl group, $R^{12}$ is an isopropyl group, a t-butyl, a phenyl group, a p-tolyl group or 2-naphthyl group, $R^{13}$ is a t-butyl group, a phenyl group, a p-tolyl group or a 2-naphthyl group, and n in $(R^{14})n$ is 0 or $(R^{14})n$ is a group in which a t-butyl group is substituted on two positions, the 2-position and 7-position of an anthracene ring.

7. The electrophotosensitive material according to claim 5, wherein the single layer photosensitive material contains the quinone derivative represented by the general formula (3) and an electron acceptor having a redox potential of −0.8 to −1.4 V.

8. The electrophotosensitive material according to claim 7, wherein the electron acceptor is a diphenoquinone derivative represented by the general formula (EA1):

(EA1)

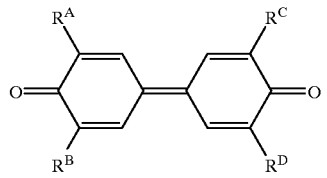

wherein $R^A$, $R^B$, $R^C$ and $R^D$ are the same or different and each represents a hydrogen atom, an alkyl group having 1 to 4 carbon atoms, an aryl group having 6 to 12 carbon atoms, an aralkyl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms, or a benzoquinone derivative represented by the general formula (EA2):

(EA2)

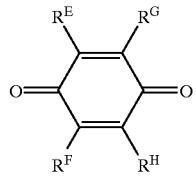

wherein $R^E$, $R^F$, $R^G$, and $R^H$ are the same or different and each represents a hydrogen atom, an alkyl group having 1 to 4 carbon atoms, an aryl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms.

9. An electrophotosensitive material comprising a conductive substrate and a single layer photosensitive material containing an electric charge generating material and an electron transferring material formed on the conductive substrate, wherein the single layer photosensitive material contains as the electron transferring material a quinone derivative represented by the general formula (1):

(1)

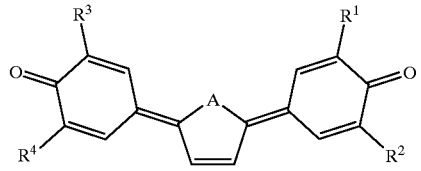

wherein A represents an oxygen atom or a sulfur atom, and $R^1$, $R^2$, $R^3$ and $R^4$ are the same or different and each represents an alkyl group having 1 to 4 carbon atoms, or an aryl group having 6 to 12 carbon atoms, which optionally has an alkyl group having 1 to 4 carbon atoms; wherein the single layer photosensitive material is produced by dispersing at least the quinone derivative represented by the general formula (1) and the electric charge generating material in a binder resin on the conductive substrate;

wherein the single layer photosensitive material contains the quinone derivative represented by the general formula (1) and an electron acceptor having a redox potential of −0.8 to −1.4 V.

10. The electrophotosensitive material according to claim 9, wherein the electron acceptor is a diphenoquinone derivative represented by the general formula (EA1):

(EA1)

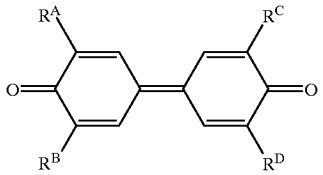

wherein $R^A$, $R^B$, $R^C$ and $R^D$ are the same or different and each represents a hydrogen atom, an alkyl group having 1 to 4 carbon atoms, an aryl group having 6 to 12 carbon atoms, an aralkyl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms, or a benzoquinone derivative represented by the general formula (EA2):

(EA2)

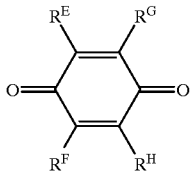

wherein $R^E$, $R^F$, $R^G$, and $R^H$ are the same or different and each represents a hydrogen atom, an alkyl group having 1 to 4 carbon atoms, an aryl group having 6 to 12 carbon atoms, a cycloalkyl group having 3 to 10 carbon atoms, an alkoxy group having 1 to 4 carbon atoms, or an amino group which optionally has an alkyl group having 1 to 4 carbon atoms.

11. An electrophotosensitive material comprising a conductive substrate and a multi-layer photosensitive material containing an electric charge generating material and an electron transferring material formed on the conductive substrate, wherein the multi-layer photosensitive material contains as the electron transferring material a quinone derivative represented by the general formula (2):.

(2)

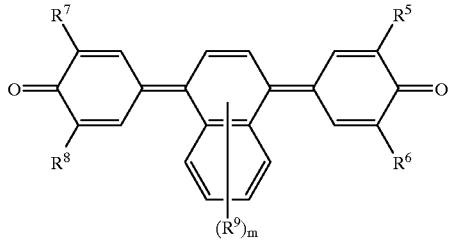

wherein $R^5$, $R^6$, $R^7$, $R^8$ and $R^9$ are the same or different and each represents an alkyl group having 1 to 4 carbon atoms, or an aryl group having 6 to 12 carbon atoms, which optionally has an alkyl group having 1 to 4 carbon atoms, and m represents an integer of 0 to 4; wherein the multi-layer photosensitive material is produced by laminating an electric charge generating layer containing the electric charge generating material and an electric charge transferring layer containing the quinone derivative represented by the general formula (2) as the electric charge transferring material in this or reverse order on the conductive substrate.

12. An electrophotosensitive material comprising a conductive substrate and a multi-layer photosensitive material containing an electric charge generating material and an electron transferring material formed on the conductive substrate, wherein the multi-layer photosensitive material contains as the electron transferring material a quinone derivative represented by the general formula (3):

(3)

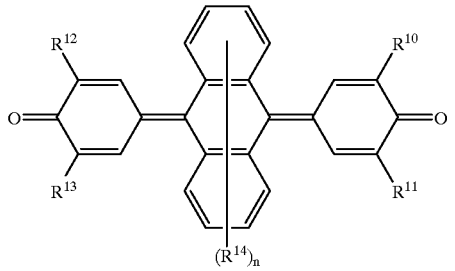

wherein $R^{10}$, $R^{11}$, $R^{12}$, $R^{13}$, and $R^{14}$ are the same or different and each represents an alkyl group having 1 to 4 carbon atoms, or an aryl group having 6 to 12 carbon atoms, which optionally has an alkyl group having 1 to 4 carbon atoms, and n represents an integer of 0 to 4; wherein the multi-layer photosensitive material is produced by laminating an electric charge generating layer containing the electric charge generating material and an electric charge transferring layer containing the quinone derivative represented by the general formula (3) as the electric charge transferring material in this or reverse order on the conductive substrate.

* * * * *

UNITED STATES PATENT AND TRADEMARK OFFICE

CERTIFICATE OF CORRECTION

PATENT NO. : 6,383,698 B1
DATED : May 7, 2002
INVENTOR(S) : Hideki Okada et al.

It is certified that error appears in the above-identified patent and that said Letters Patent is hereby corrected as shown below:

Title page,
Item [30], Foreign Application Priority Data, insert -- November 30, 1999 -- and delete "Nov. 19, 1999"

Signed and Sealed this

Nineteenth Day of November, 2002

*Attest:*

*Attesting Officer*

JAMES E. ROGAN
*Director of the United States Patent and Trademark Office*